US007318024B2

(12) United States Patent
Murashima

(10) Patent No.: US 7,318,024 B2
(45) Date of Patent: Jan. 8, 2008

(54) METHOD OF CONVERTING CODES BETWEEN SPEECH CODING AND DECODING SYSTEMS, AND DEVICE AND PROGRAM THEREFOR

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 829 days.

(21) Appl. No.: 10/167,369

(22) Filed: Jun. 11, 2002

(65) Prior Publication Data

US 2003/0033142 A1 Feb. 13, 2003

(30) Foreign Application Priority Data

Jun. 15, 2001 (JP) ..... 2001-181088

(51) Int. Cl.
*G10L 19/06* (2006.01)
*G10L 19/14* (2006.01)

(52) U.S. Cl. ..... 704/219

(58) Field of Classification Search ..... 704/219, 704/230

See application file for complete search history.

(56) References Cited

U.S. PATENT DOCUMENTS 5,230,036 A * 7/1993 Akamine et al. ..... 704/200
6,334,105 B1 * 12/2001 Ehara ..... 704/258
2002/0077812 A1 * 6/2002 Suzuki et al. ..... 704/230

FOREIGN PATENT DOCUMENTS

JP H 05-002159 1/1993
JP H 08-146997 6/1996
JP 2002-202799 7/2002

OTHER PUBLICATIONS

Schroeder M.R., "Code-Excited Linear Prediction (CELP):High-Quality Speech at Very Low Bit Rates", *Proc. of IEEE Int. Conf. on Acoust., Speech and Signal Processing* 937-940 (1985).

"Coding of Speech at 8 Kbits/s Using Conjugate-Structure Algebraic-Code-Excited Linear-Prediction (CS-ACELP)", *ITU-T Recommendation G.729* (1996).

Kang H-G. et al., "Improving Transcoding Capability of Speech Coders in Clean and Frame Erasured Channel Environments", *Proc. of IEEE Workshop on Speech Coding* 78-80 (2000).

(Continued)

*Primary Examiner*—Tālivaldis Ivars Šmits
*Assistant Examiner*—Thomas E. Shortledge
(74) *Attorney, Agent, or Firm*—Scully, Scott, Murphy & Presser, P.C.

(57) ABSTRACT

A second evaluation value calculation circuit calculates an evaluation value from a first linear prediction coefficient, a second linear prediction coefficient stored and held, a third linear prediction coefficient read from a table in which a plurality of linear prediction coefficients are stored in advance, and a fourth linear prediction coefficient selected, stored and held among the third linear prediction coefficients read from the table in the past, while a second evaluation value minimizing circuit selects the third linear prediction coefficient with which the evaluation value is the minimum and outputs a code corresponding to the selected third linear prediction coefficient as a code decodable by a second coding and decoding system.

55 Claims, 16 Drawing Sheets

OTHER PUBLICATIONS

Shu-Min Tsai, et al., "GSM to G.729 Speech Transcoder", *ICECS 2001. 8th IEEE International Conference on Electronics, Circuits and Systems*, (2001) pp. 485-488.

Suzuki et al., "Speech Transcoding Technique for 3G Mobile Communication" The Technical Report of the Institute of Electronics Information and Communication Engineers of Japan, MoMuC2 001-9, Apr. 19, 2001, pp. 47-52, vol. 101, No. 26, Japan.

* cited by examiner

METHOD OF CONVERTING CODES BETWEEN SPEECH CODING AND DECODING SYSTEMS, AND DEVICE AND PROGRAM THEREFOR

BACKGROUND OF THE INVENTION

1. Field of the Invention

The present invention relates to a coding and decoding method for transmitting or accumulating a speech signal at a low bit rate, and more particular, to a code conversion method, in speech communication using different coding and decoding systems, of converting a code obtained by coding speech by a certain system into a code decodable by other system so as to have high sound quality by a small amount of operation, and a device and a program therefor.

2. Description of the Related Art

Widely used as a method of coding a speech signal with high efficiency and at medium or low rates is a method of coding a speech signal separately as a linear prediction (LP) filter and an excitation signal which drives the filter. One of representatives of such method is the code excited linear prediction (CELP). In CELP, by driving a linear prediction filter having a linear prediction coefficient indicative of frequency characteristics of input speech by an excitation signal represented by a sum of an adaptive codebook (ACB) indicative of a pitch cycle of the input speech and a fixed codebook (FCB) composed of random numbers and pulses, a composite speech signal is obtained. At this time, the ACB component and the FCB component are multiplied by the respective gains (ACB gain and FCB gain). Concerning CELP, reference is made to M. Schroeder, "Code Excited Linear Prediction: High Quality Speech at Very Low Bit Rates" (Proc. of IEEE Int. Conf. on Acoust., Speech and Signal Processing, pp. 937-940, 1985) (referred to as Literature 1).

Assuming, for example, interconnection between a 3G mobile network and a wire packet network, there arises a problem in interconnection between standard speech coding systems used in the respective networks in some cases. Although one of most simple solutions to the problem is tandem connection, because from a code string obtained by coding a speech using one standard system, a speech signal is once decoded using the standard system and the decoded speech signal is again coded using the other standard system, this solution might invite degradation of speech quality, increase of a delay and the volume of calculation in general.

On the other hand, the code conversion system of converting a code obtained by coding speech using one standard system into a code decodable by the other standard system has a possibility of solving the above-described problem. Regarding the method of converting a code, reference is made to Hong-Goo Kang et. al, "Improving Transcoding Capability of Speech Coders in Clean and Frame Erasured Channel Environments" (Proc. of IEEE Workshop on Speech Coding 2000, pp. 78-80, 2000) (referred to as Literature 2).

FIG. 12 is a diagram showing one example of a structure of a code conversion device for converting a code obtained by coding speech using a first speech coding system (system A) into a code decodable by a second system (system B). In the system A, it is assumed that coding of a linear prediction coefficient is conducted at every $T_{fr}^{(A)}$ msec cycle (frame) and coding of such components of an excitation signal as ACB, FCB and a gain is conducted at every $T_{sfr}^{(A)}=T_{fr}^{(A)}/N_{sfr}^{(A)}$ msec cycle (sub-frame), while in the system B, it is assumed that coding of a linear prediction coefficient is conducted at every $T_{fr}^{(B)}$ msec cycle (frame) and coding of components of an excitation signal is conducted at $T_{sfr}^{(B)}=T_{fr}^{(B)}/N_{sfr}^{(B)}$ msec cycle (sub-frame). Here, the code conversion device described in the Literature 2 conducts, for example, code conversion between ITU-T Standard G. 729 and North American TDMA System Standard IS-641. Assuming the former to be the system A and the latter to be the system B, $T_{fr}^{(A)}$ will be 10 msec and $T_{fr}^{(B)}$ will be 20 msec, and $T_{sfr}^{(A)}$ and $T_{sfr}^{(B)}$ will be 5 msec.

In the following description, assume that between a frame length $L_{fr}^{(A)}$ of the system A and a frame length $L_{fr}^{(B)}$ of the system B, a relationship of $L_{fr}^{(B)}=2\cdot L_{fr}^{(A)}$ holds and that the number of sub-frames is $N_{sfr}^{(A)}=2$ and $N_{sfr}^{(B)}=4$. Here, with 8000 Hz as a sampling frequency, $L_{fr}^{(A)}$ will be 160 samples, $L_{fr}^{(B)}$ will be 320 samples, and $L_{sfr}^{(A)}$ and $L_{sfr}^{(B)}$ will be 80 samples in the above-described example.

With reference to FIG. 12, each component of the conventional code conversion device will be described.

Input a code string obtained by coding speech by the first system (system A) through an input terminal 10.

A code separation circuit 1010 separates, from the code string applied through the input terminal 10, codes corresponding to a linear prediction coefficient (LP coefficient), ACB, FCB, an ACB gain and an FCB gain, that is, an LP coefficient code, an ACB code, an FCB code and a gain code. Here, assuming that the ACB gain and the FCB gain are coded and decoded in the lump, it will be referred to as a gain and its code as a gain code for the purpose of simplification. Then, output the LP coefficient code to an LP coefficient code conversion circuit 100, the ACB code to an ACB code conversion circuit 200, the FCB code to an FCB code conversion circuit 300 and the gain code to a gain code conversion circuit 400.

The LP coefficient code conversion circuit 100 receives input of the LP coefficient code output from the code separation circuit 1010 to convert the LP coefficient code into a code decodable by the second system (system B). The converted LP coefficient code is output to a code multiplexing circuit 1020.

The ACB code conversion circuit 200 receives input of the ACB code output from the code separation circuit 1010 to convert the ACB code into a code decodable by the system B. The converted ACB code is output to the code multiplexing circuit 1020.

The FCB code conversion circuit 300 receives input of the FCB code output from the code separation circuit 1010 to convert the FCB code into a code decodable by the system B. The converted FCB code is output to the code multiplexing circuit 1020.

The gain code conversion circuit 400 receives input of the gain code output from the code separation circuit 1010 to convert the gain code into a code decodable by the system B. The converted gain code is output to the code multiplexing circuit 1020.

More specific operation of each conversion circuit will be described in the following.

The LP coefficient code conversion circuit 100 decodes a first LP coefficient code applied from the code separation circuit 1010 by an LP coefficient decoding method of the first system (system A) to obtain a first LP coefficient. Next, the circuit 100 quantizes and codes the first LP coefficient by LP coefficient quantization method and coding method of the second system (system B) to obtain a second LP coefficient code. Then, the circuit outputs the obtained code as a code decodable by an LP coefficient decoding method of the second system (system B) to the code multiplexing circuit 1020.

The ACB code conversion circuit 200 re-reads a first ACB code applied from the code separation circuit 1010 in terms of a corresponding relationship between the codes in the first system (system A) and the codes in the second system (system B) to obtain a second ACB code. Then, the circuit 200 outputs the obtained code as a code decodable by an ACB decoding method of the second system (system B) to the code multiplexing circuit 1020.

Here, with reference to FIG. 13, description will be made of re-reading of a code. Assume, for example, when the ACB code $i_T^{(A)}$ in the system A is 56, its corresponding ACB delay $T^{(A)}$ is 76. In the system B, assuming that when ACB code $i_T^{(A)}$ is 53 and its corresponding ACB delay $T^{(A)}$ is 76, in order to convert the ACB code from the system A to the system B such that the value of the ACB delay is the same (76 in this case), it is only necessary to make the ACB code 56 in the system A correspond to the ACB code 53 in the system B. The description of re-reading of a code is completed here to again return to the description of FIG. 12.

The FCB code conversion circuit 300 obtains a second FCB code by re-reading a first FCB code applied from the code separation circuit 1010 in terms of the corresponding relationship between codes in the first system (system A) and codes in the second system (system B). Then, the circuit 300 outputs the obtained code as a code decodable by an FCB decoding method of the second system (system B) to the code multiplexing circuit 1020. Here, re-reading of a code can be realized by the same method as that described above for the conversion of the ACB code or by the same method as that for the conversion of the LP coefficient code which will be described later.

The gain code conversion circuit 400 decodes a first gain code applied from the code separation circuit 1010 by a gain decoding method of the first system (system A) to obtain a first gain. Next, the circuit 400 quantizes and codes the first gain by gain quantization method and coding method of the second system (system B) to obtain a second gain code. Then, the circuit outputs the gain code as a code decodable by a gain decoding method of the second system (system B) to the code multiplexing circuit 1020.

Here, since conversion of the gain code can be realized by the same method as that for the conversion of the LP coefficient code, noting only the conversion of the LP coefficient code for the purpose of simplification, it will be described in detail in the following.

With reference to FIG. 14, each component of the LP coefficient code conversion circuit 100 will be described.

Since in many of the standard systems including the above-described ITU-T standard G.729, an LSP is coded and decoded with an LP coefficient expressed by a linear spectral pair (LSP), it is assumed in the following that the LP coefficient is expressed by the LSP. Here, as to conversion from the LP coefficient to the LSP and conversion from the LSP to the LP coefficient, reference is made to a well-known method, for example, recitation in the 3.2.3 section and the 3.2.6 section in "Coding of Speech at 8 kbit/s Using Conjugate-Structure Algebraic-Code-Excited Linear-Prediction (CS-ACELP)" (ITU-T Recommendation G. 729) (referred to as Literature 3).

An LP coefficient decoding circuit 110 decodes the LP coefficient code to obtain the corresponding LSP. The LP coefficient decoding circuit 110, which includes a first LSP codebook 111 in which a plurality of sets of LSP are stored, receives input of the LP coefficient code output from the code separation circuit 1010 through an input terminal 31 and reads an LSP corresponding to the LP coefficient code from the first LSP codebook 111 to output the read LSP to an LP coefficient modification circuit 120. Here, decoding the LSP from the LP coefficient code is conducted according to the LP coefficient (represented by LSP here) decoding method of the system A using an LSP codebook of the system A.

The LP coefficient modification circuit 120 receives input of the LSP output from the LP coefficient decoding circuit 110 and modifies the LSP to output the LSP modified (modified LSP) to an LP coefficient coding circuit 130. Here, assuming that a relationship between a frame length in the system A and a frame length in the system B is expressed as $L_{fr}^{(B)}=2\cdot L_{fr}^{(A)}$, modification of the LSP can be conducted based on, for example, the following expression because as shown in FIG. 15, two frames in the system A (a (2n−1)th frame and a 2n-th frame) correspond to one frame (an n-th frame) in the system B:

$$\tilde{q}^{(A)}(n)=0.5\cdot(q^{(A)}(2n-1)+q^{(A)}(2n))$$

wherein the following expression represents the modified LSP (i.e. output of the LP coefficient modification circuit 120) in the system A and is used in the n-th frame in the system B:

$$\tilde{q}^{(A)}(n)$$

$q^{(A)}(m)$ denotes the LSP output from the LP coefficient decoding circuit 110 in the m-th frame of the system A. In addition, assume that $q^{(A)}(n)$ and the following expression represent P-dimensional vectors (P: linear prediction degree):

$$\tilde{q}^{(A)}(n)$$

For the modification of the LSP, such a simpler method based on the following expression can be also used:

$$\tilde{q}^{(A)}(n)=q^{(A)}(2n)$$

As to a more complicated modification method, recitation in the third section of the Literature 2 will be referred to.

The LP coefficient coding circuit 130 receives input of the modified LSP output from the LP coefficient modification circuit 120, reads an LSP and its corresponding code from a second LSP codebook 131 in which a plurality of sets of LSP are stored and quantizes and codes the modified LSP to output the obtained code, that is, the LP coefficient code, to the code multiplexing circuit 1020 through an output terminal 32. Here, quantization and coding of the modified LSP are conducted according to the LP coefficient quantization method and coding method in the system B using an LSP codebook of the system B.

With reference to FIG. 16, each component of the LP coefficient coding circuit 130 will be described.

The second LSP codebook 131, which stores a plurality of sets of LSP, outputs the LSP and its corresponding code to an evaluation value calculation circuit 132.

The evaluation value calculation circuit 132 receives input of the modified LSP output from the LP coefficient modification circuit 120 through an input terminal 33, reads an LSP and its corresponding code from the second LSP codebook 131 in which a plurality of sets of LSP are stored and calculates an evaluation value from the same to output the evaluation value and the code to an evaluation value minimizing circuit 133. Calculation of the evaluation value is conducted for all the LSP stored in the LSP codebook. Evaluation value is defined as a square error of the modified LSP as a target and the LSP stored in the LSP codebook and is expressed by the following expression:

$$D_k(n) = \sum_{i=1}^{P} (\tilde{q}_i(n) - \hat{q}_{k,i}(n))^2$$

wherein $D_k(n)$ denotes an evaluation value in the n-th frame, the following expressions each represent an i-th element:

$\tilde{q}_i(n)$ and $\hat{q}_{k,i}(n)$ of the following P-dimensional vectors (P: linear prediction degree):

$\tilde{q}(n)=\tilde{q}^{(A)}(n)$ and $\hat{q}_k(n)$ the following expression represents a modified LSP in the n-th frame:

$\tilde{q}(n)=\tilde{q}^{(A)}(n)$ the following expression represents an LSP read from the LSP codebook in the n-th frame:

$\hat{q}_k(n)$ and the following expression represents the size of the LSP codebook (the number of LSP sets stored):

$k=1, \ldots, N_{qcb}$ $N_{qcb}$

The evaluation value minimizing circuit 133 receives input of the evaluation value output from the evaluation value calculation circuit 132 and the code corresponding to the LSP used in the calculation of the evaluation value, selects the code with which the evaluation value is the minimum to output the selected code as the LP coefficient code to the code multiplexing circuit 1020 through the output terminal 32.

The description of the LP coefficient coding circuit 130 and the LP coefficient code conversion circuit 100 including the same is completed here to return again to the description of FIG. 12.

The code multiplexing circuit 1020 receives input of the LP coefficient code output from the LP coefficient code conversion circuit 100, the ACB code output from the ACB code conversion circuit 200, the FCB code output from the FCB code conversion circuit 300 and the gain code output from the gain code conversion circuit 400 to output a code string obtained by multiplexing these codes through an output terminal 20.

The above-described conventional code conversion device, however, has a problem that in the conversion of a code corresponding to such a parameter as a linear prediction coefficient or a gain, allophone might be generated in decoded speech which is generated from a converted code.

The reason is that a desirable mode of change in time of the parameter obtained from speech applied to a coder in the first system and a mode of change in time of the parameter obtained by decoding the coded code by a decoder in the second system largely differ from each other.

This derives from the fact that a mode of change in time of the parameter obtained by decoding the code output from the first system by a parameter decoding method of the first system is already different from a desired mode of change in time of the parameter obtained from the input speech because of quantization in the first system, and the parameter obtained by decoding is further quantized by a parameter quantization method of the second system.

SUMMARY OF THE INVENTION

An object of the present invention, taking the above-described problems into consideration, is to provide a device and a method which enable generation of allophone to be suppressed in decoded speech which is generated from a converted code at the conversion of a code corresponding to a parameter, which generation is caused by large difference between a desirable mode of change in time of a parameter obtained from speech applied to a coder in a first system and a mode of change in time of a parameter obtained by decoding a converted code at a decoder in a second system, and a program therefor.

According to the first aspect of the invention, a code conversion method of converting a first code string into a second code string, comprises a first step of obtaining a first linear prediction coefficient from a code corresponding to a linear prediction coefficient out of the first code string, a second step of storing and holding the first linear prediction coefficient as a second linear prediction coefficient, a third step of calculating, from the first linear prediction coefficient, the second linear prediction coefficient and a third linear prediction coefficient sequentially read from a table in which a plurality of linear prediction coefficients are stored in advance, an evaluation value for each the third linear prediction coefficient, and a fourth step of selecting the third linear prediction coefficient with which the evaluation value is the minimum from the table to output a code corresponding to selected the third linear prediction coefficient as a code corresponding to a linear prediction coefficient in the second code string.

In the preferred construction, at the third step, from the first linear prediction coefficient, the second linear prediction coefficient, the third linear prediction coefficient sequentially read from the table, and a fourth linear prediction coefficient selected, and stored and held among the third linear prediction coefficients read in the past from the table, an evaluation value for each the third linear prediction coefficient is calculated, and at the fourth step, the third linear prediction coefficient with which the evaluation value is the minimum is selected from the table to output a code corresponding to selected the third linear prediction coefficient as a code which is corresponding to the linear prediction coefficient in the second code string and is decodable by a linear prediction coefficient decoding method in a second coding and decoding system, and which further comprises a fifth step of storing and holding selected the third linear prediction coefficient as the fourth linear prediction coefficient.

In another preferred construction, at the third step, a first square error is calculated from the first linear prediction coefficient and the third linear prediction coefficient and a second square error is calculated from the second linear prediction coefficient and the third linear prediction coefficient to calculate an evaluation value from the second square error and the first square error.

In another preferred construction, at the third step, a first square error is calculated from the first linear prediction coefficient and the third linear prediction coefficient, a first amount of change in time is calculated from the first linear prediction coefficient and the second linear prediction coefficient, a second amount of change in time is calculated from the third linear prediction coefficient and the fourth linear prediction coefficient, and a second square error is calculated from the first amount of change in time and the second amount of change in time to calculate an evaluation value from the second square error and the first square error.

In another preferred construction, the second square error is multiplied by a control coefficient and the multiplication result is added to the first square error to calculate an evaluation value.

In another preferred construction, a value obtained by internally dividing the first square error and the second square error by a ratio determined by the control coefficient is taken as an evaluation value.

In another preferred construction, the first amount of change in time is calculated from a difference between the first linear prediction coefficient and the second linear prediction coefficient and the second amount of change in time is calculated from a difference between the third linear prediction coefficient and the fourth linear prediction coefficient.

In another preferred construction, a third amount of change in time is calculated from the first linear prediction coefficient and the second linear prediction coefficient and the control coefficient is calculated from the third amount of change in time.

In another preferred construction, the third amount of change in time is calculated from a difference between the first linear prediction coefficient and the second linear prediction coefficient.

In another preferred construction, when the third amount of change in time is less than a first threshold value, the control coefficient is expressed by a first constant, when the amount of change in time is not less than the first threshold value and less than a second threshold value, the control coefficient is expressed by a function of the third amount of change in time and in the remaining cases, the control coefficient is expressed by a second constant.

According to the second aspect of the invention, a code conversion device for converting a first code string into a second code string, comprises a linear prediction coefficient decoding circuit for obtaining a first linear prediction coefficient from a code corresponding to a linear prediction coefficient out of the first code string, a storage circuit for storing and holding the first linear prediction coefficient as a second linear prediction coefficient, an evaluation value calculation circuit for calculating, from the first linear prediction coefficient, the second linear prediction coefficient and a third linear prediction coefficient sequentially read from a table in which a plurality of linear prediction coefficients are stored in advance, an evaluation value for each the third linear prediction coefficient, and an evaluation value minimizing circuit for selecting the third linear prediction coefficient with which the evaluation value is the minimum from the table to output a code corresponding to selected the third linear prediction coefficient as a code corresponding to a linear prediction coefficient in the second code string.

In the preferred construction, the evaluation value calculation circuit calculates an evaluation value for each the third linear prediction coefficient from the first linear prediction coefficient, the second linear prediction coefficient, the third linear prediction coefficient sequentially read from the table, and a fourth linear prediction coefficient stored and held, and the evaluation value minimizing circuit selects the third linear prediction coefficient with which the evaluation value is the minimum from the table to output a code corresponding to selected the third linear prediction coefficient as a code corresponding to the linear prediction coefficient in the second code string, and which further comprises a second storage circuit for storing and holding selected the third linear prediction coefficient as the fourth linear prediction coefficient.

In another preferred construction, the evaluation value calculation circuit calculates a first square error from the first linear prediction coefficient and the third linear prediction coefficient and calculates a second square error from the second linear prediction coefficient and the third linear prediction coefficient to calculate an evaluation value from the second square error and the first square error.

In another preferred construction, the evaluation value calculation circuit calculates a first square error from the first linear prediction coefficient and the third linear prediction coefficient, calculates a first amount of change in time from the first linear prediction coefficient and the second linear prediction coefficient, calculates a second amount of change in time from the third linear prediction coefficient and the fourth linear prediction coefficient, and calculates a second square error from the first amount of change in time and the second amount of change in time to calculate an evaluation value from the second square error and the first square error.

In another preferred construction, the evaluation value calculation circuit multiplies the second square error by a control coefficient and adds the multiplication result to the first square error to calculate an evaluation value.

In another preferred construction, the evaluation value calculation circuit takes a value obtained by internally dividing the first square error and the second square error by a ratio determined by the control coefficient as an evaluation value.

In another preferred construction, the evaluation value calculation circuit calculates the first amount of change in time from a difference between the first linear prediction coefficient and the second linear prediction coefficient and calculates the second amount of change in time from a difference between the third linear prediction coefficient and the fourth linear prediction coefficient.

In another preferred construction, the evaluation value calculation circuit calculates a third amount of change in time from the first linear prediction coefficient and the second linear prediction coefficient to calculate the control coefficient from the third amount of change in time.

In another preferred construction, the evaluation value calculation circuit calculates the third amount of change in time from a difference between the first linear prediction coefficient and the second linear prediction coefficient.

In another preferred construction, when the third amount of change in time is less than a first threshold value, the evaluation value calculation circuit expresses the control coefficient by a first constant, when the amount of change in time is not less than the first threshold value and less than a second threshold value, expresses the control coefficient by a function of the third amount of change in time and in the remaining cases, expresses the control coefficient by a second constant.

According to the third aspect of the invention, a code conversion program for conducting code conversion by controlling a computer which forms a code conversion device for converting a first code string into a second code string, comprising the functions (a) of obtaining a first linear prediction coefficient from a code corresponding to a linear prediction coefficient out of the first code string, (b) of storing and holding the first linear prediction coefficient as a second linear prediction coefficient, (c) of calculating, from the first linear prediction coefficient, the second linear prediction coefficient and a third linear prediction coefficient sequentially read from a table in which a plurality of linear prediction coefficients are stored in advance, an evaluation value for each the third linear prediction coefficient, and (d) of selecting the third linear prediction coefficient with which the evaluation value is the minimum from the table to output a code corresponding to selected the third linear prediction coefficient as a code corresponding to a linear prediction coefficient in the second code string.

According to another aspect of the invention, a code conversion method of converting a first code string into a second code string, comprising the steps of a first step of obtaining a first gain from a code corresponding to a gain out of the first code string, a second step of storing and holding the first gain as a second gain, a third step of calculating, from the first gain, the second gain and a third gain sequentially read from a table in which a plurality of gains are stored in advance, an evaluation value for each the third gain, and a fourth step of selecting the third gain with which the evaluation value is the minimum from the table to output a code corresponding to selected the third gain as a code corresponding to a gain in the second code string.

In the preferred construction, at the third step, an evaluation value for each the third gain is calculated from the first gain, the second gain, the third gain sequentially read from the table, and a fourth gain selected, stored and held among third linear prediction coefficients read from the table in the past, and at the fourth step, the third gain with which the evaluation value is the minimum is selected from the table and a code corresponding to selected the third gain is output as a code which is corresponding to the gain in the second code string and is decodable by a linear prediction coefficient decoding method in a second coding and decoding system, and which further comprises a fifth step of storing and holding selected the third gain as the fourth gain.

In another preferred construction, at the third step, a first square error is calculated from the first gain and the third gain and a second square error is calculated from the second gain and the third gain to calculate an evaluation value from the second square error and the first square error.

In another preferred construction, at the third step, a first square error is calculated from the first gain and the third gain, a first amount of change in time is calculated from the first gain and the second gain, a second amount of change in time is calculated from the third gain and the fourth gain, and a second square error is calculated from the first amount of change in time and the second amount of change in time to calculate an evaluation value from the second square error and the first square error.

In another preferred construction, the second square error is multiplied by a control coefficient and the multiplication result is added to the first square error to calculate an evaluation value.

In another preferred construction, a value obtained by internally dividing the first square error and the second square error by a ratio determined by the control coefficient is taken as an evaluation value.

In another preferred construction, the first amount of change in time is calculated from a difference between the first gain and the second gain and the second amount of change in time is calculated from a difference between the third gain and the fourth gain.

In another preferred construction, a third amount of change in time is calculated from the first gain and the second gain to calculate the control coefficient from the third amount of change in time.

In another preferred construction, the third amount of change in time is calculated from a difference between the first gain and the second gain.

In another preferred construction, when the third amount of change in time is less than a first threshold value, the control coefficient is expressed by a first constant, when the amount of change in time is not less than the first threshold value and less than a second threshold value, the control coefficient is expressed by a function of the third amount of change in time and in the remaining cases, the control coefficient is expressed by a second constant.

According to a further aspect of the invention, a code conversion device for converting a first code string into a second code string, comprises a gain decoding circuit for obtaining a first gain from a code corresponding to a gain out of the first code string, a storage circuit for storing and holding the first gain as a second gain, an evaluation value calculation circuit for calculating, from the first gain, the second gain and a third gain sequentially read from a table in which a plurality of gains are stored in advance, an evaluation value for each the third gain, and an evaluation value minimizing circuit for selecting the third gain with which the evaluation value is the minimum from the table to output a code corresponding to selected the third gain as a code corresponding to a gain in the second code string.

In the preferred construction, the evaluation value calculation circuit calculates an evaluation value for each the third gain from the first gain, the second gain, the third gain sequentially read from the table, and a fourth gain stored and held, and the evaluation value minimizing circuit selects the third gain with which the evaluation value is the minimum from the table to output a code corresponding to selected the third gain as a code corresponding to the gain in the second code string, and which further comprises a second storage circuit for storing and holding selected the third gain as the fourth gain.

In another preferred construction, the evaluation value calculation circuit calculates a first square error from the first gain and the third gain and a second square error from the second gain and the third gain to calculate an evaluation value from the second square error and the first square error.

In another preferred construction, the evaluation value calculation circuit calculates a first square error from the first gain and the third gain, a first amount of change in time from the first gain and the second gain, a second amount of change in time from the third gain and the fourth gain, and a second square error from the first amount of change in time and the second amount of change in time to calculate an evaluation value from the second square error and the first square error.

In another preferred construction, the second square error is multiplied by a control coefficient and the multiplication result is added to the first square error to calculate an evaluation value.

In another preferred construction, a value obtained by internally dividing the first square error and the second square error by a ratio determined by the control coefficient is taken as an evaluation value.

In another preferred construction, the first amount of change in time is calculated from a difference between the first gain and the second gain and the second amount of change in time is calculated from a difference between the third gain and the fourth gain.

In another preferred construction, a third amount of change in time is calculated from the first gain and the second gain to calculate the control coefficient from the third amount of change in time.

In another preferred construction, the third amount of change in time is calculated from a difference between the first gain and the second gain.

In another preferred construction, when the third amount of change in time is less than a first threshold value, the control coefficient is expressed by a first constant, when the amount of change in time is not less than the first threshold value and less than a second threshold value, the control coefficient is expressed by a function of the third amount of change in time and in the remaining cases, the control coefficient is expressed by a second constant.

According to a still further aspect of the invention, a code conversion program for conducting code conversion by controlling a computer which forms a code conversion device for converting a first code string into a second code string, comprising the functions (a) of obtaining a first gain from a code corresponding to a gain out of the first code string, (b) of storing and holding the first gain as a second gain, (c) of calculating, from the first gain, the second gain and a third gain sequentially read from a table in which a plurality of gains are stored in advance, an evaluation value for each the third gain, and (d) of selecting the third gain with which the evaluation value is the minimum from the table to output a code corresponding to selected the third gain as a code corresponding to a gain in the second code string.

According to the present invention, in code conversion between the first system and the second system, so that at the time of quantizing a parameter, which is decoded from a code using a parameter decoding method of the first system, by using a parameter quantizing method of the second system, a mode of change in time of the quantized parameter approximates to the parameter as of before quantization, an evaluation value is minimized which includes a difference between the amounts of change in time of the parameters as of before and after quantization that is calculated in the quantization from the current and past parameters as of before the quantization and the current and past parameters as of after the quantization.

The difference between the amounts of change in time of the parameters as of before and after the quantization is accordingly reduced to result in decreasing a difference between the desired mode of change in time of the parameter obtained from speech applied to the coder in the first system and the mode of change in time of the parameter obtained by decoding the converted code in the decoder in the second system, thereby suppressing generation of allophone in decoded speech which is generated from the converted code.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
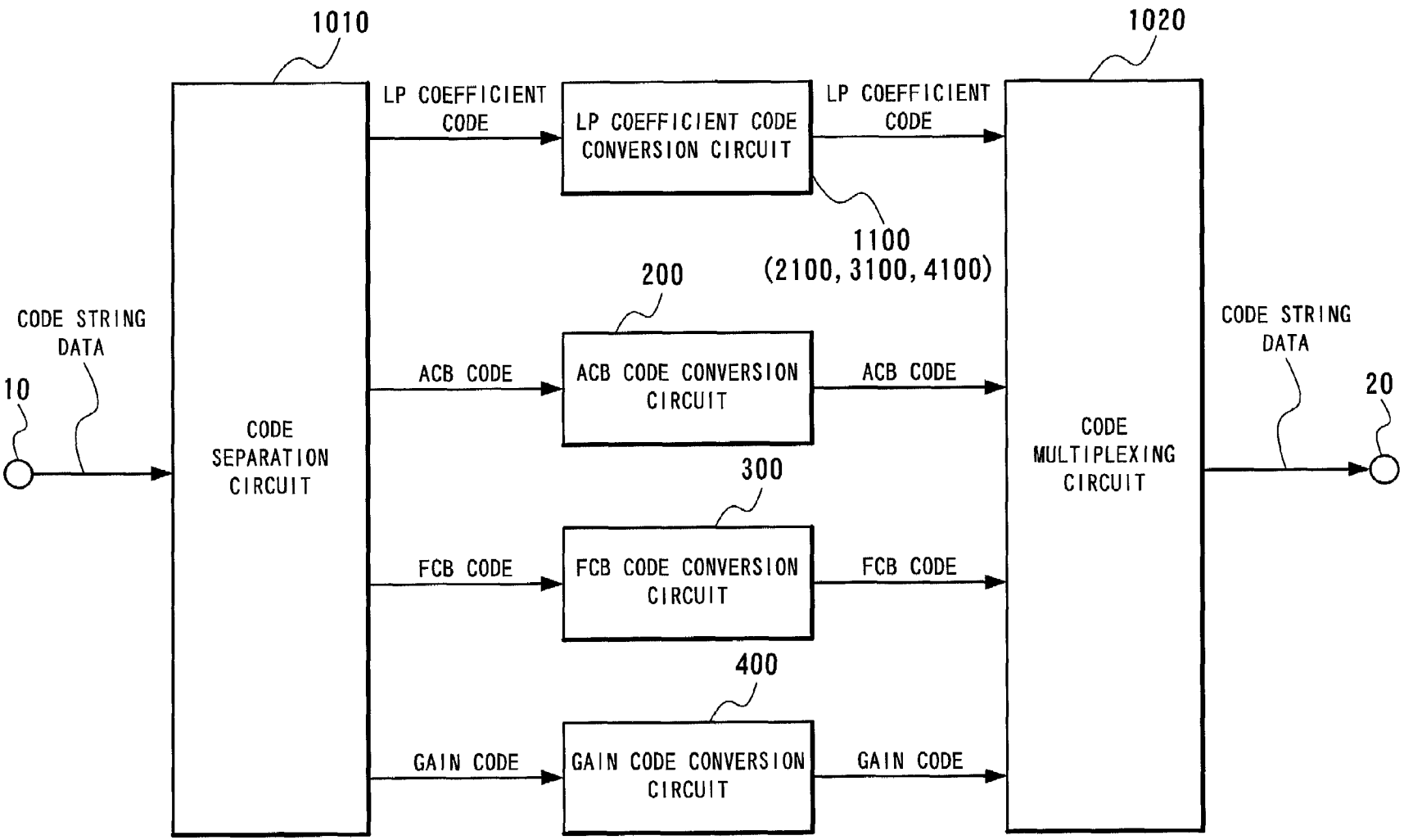
FIG. 1 is a diagram showing a structure of a code conversion device according to the first to fourth embodiments of the present invention.

FIG. 1 is a diagram showing a structure of a code conversion device according to a first embodiment of the present invention.

Figure 12:
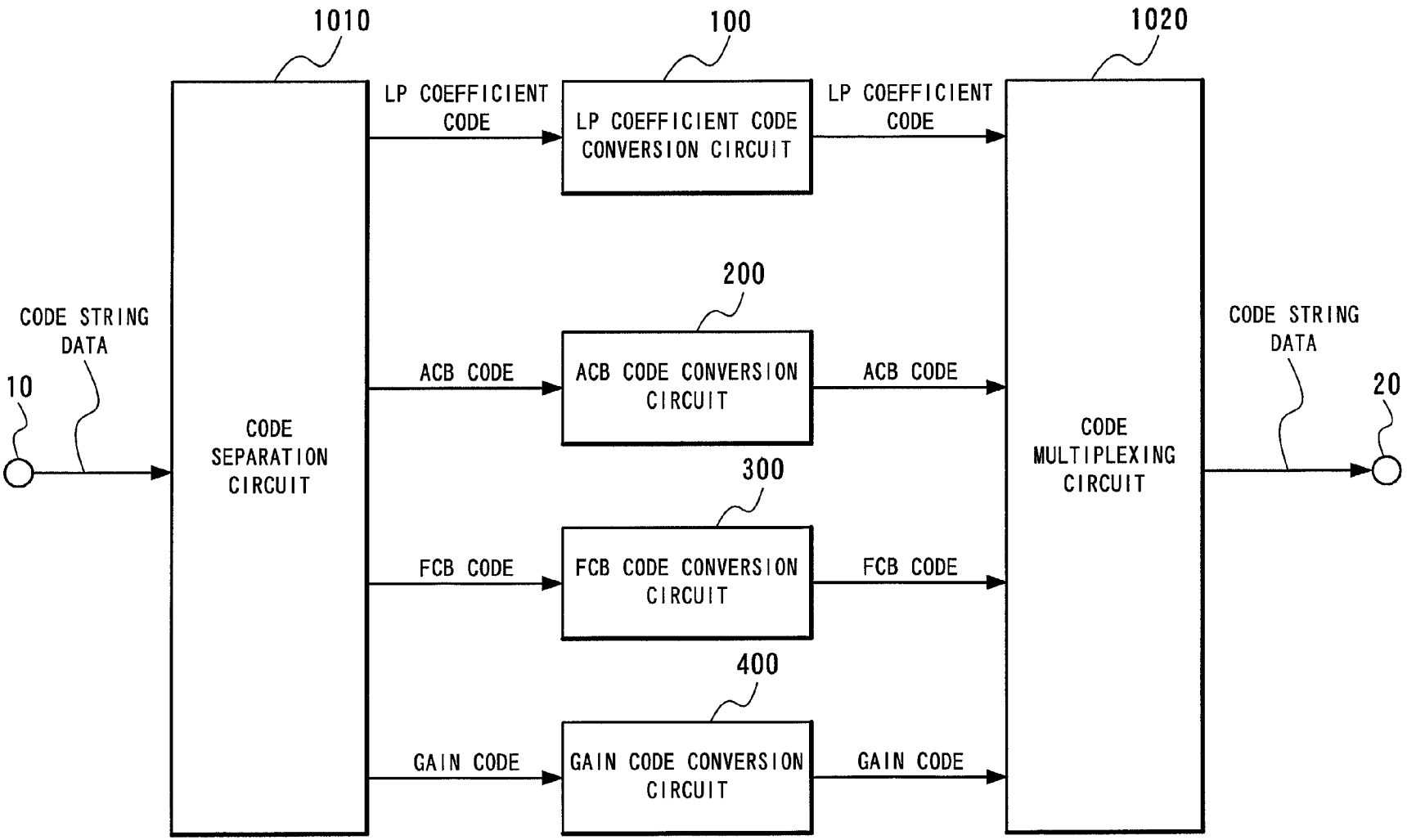
FIG. 12 (PRIOR ART)
FIG. 12 is a diagram showing a structure of a conventional code conversion device.
Figure 13:
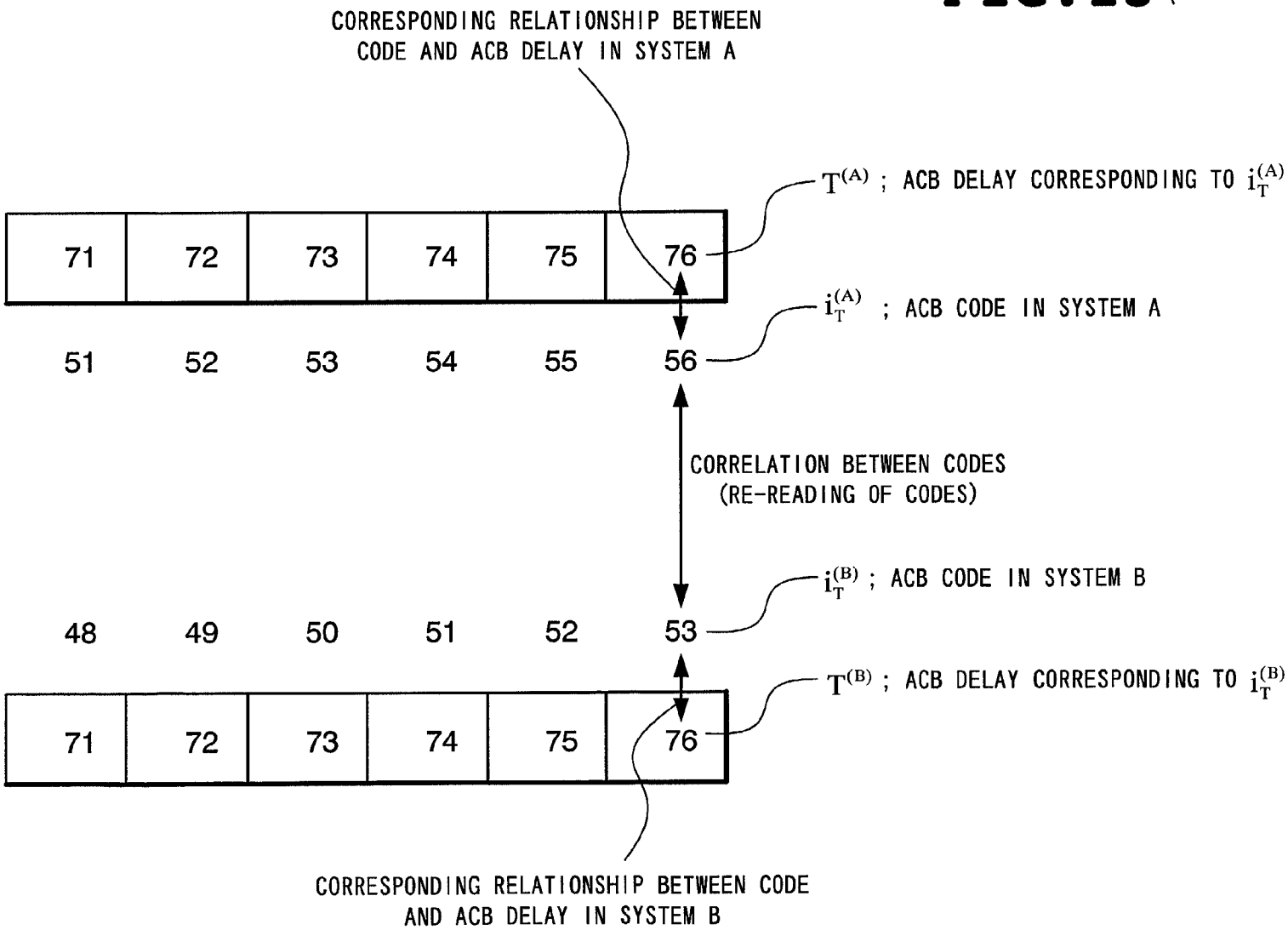
FIG. 13 (PRIOR ART)
FIG. 13 is a diagram for use in explaining a corresponding relationship between an ACB code and an ACB delay and a method of re-reading the ACB code.

In FIG. 1, the same or equivalent components as/to those of FIG. 12 are given the same reference numerals. In FIG. 1, since the input terminal 10, the output terminal 20, the code separation circuit 1010, the code multiplexing circuit 1020, the ACB code conversion circuit 200, the FCB code conversion circuit 300 and the gain code conversion circuit 400 are the same as the components shown in FIG. 12, no description will be made thereof and the following description will be mainly made of a difference from the structure shown in FIG. 12.

With reference to FIG. 1, the difference in structure from that shown in FIG. 12 is that the LP coefficient code conversion circuit 100 is replaced by an LP coefficient code conversion circuit 1100. Since also in second, third and fourth embodiments which will be described later, the difference resides in that the LP coefficient code conversion circuit 100 is replaced by LP coefficient code conversion circuits 2100, 3100 and 4100, respectively, these reference numerals are indicated together to use FIG. 1 also for these embodiments.

Figure 2:
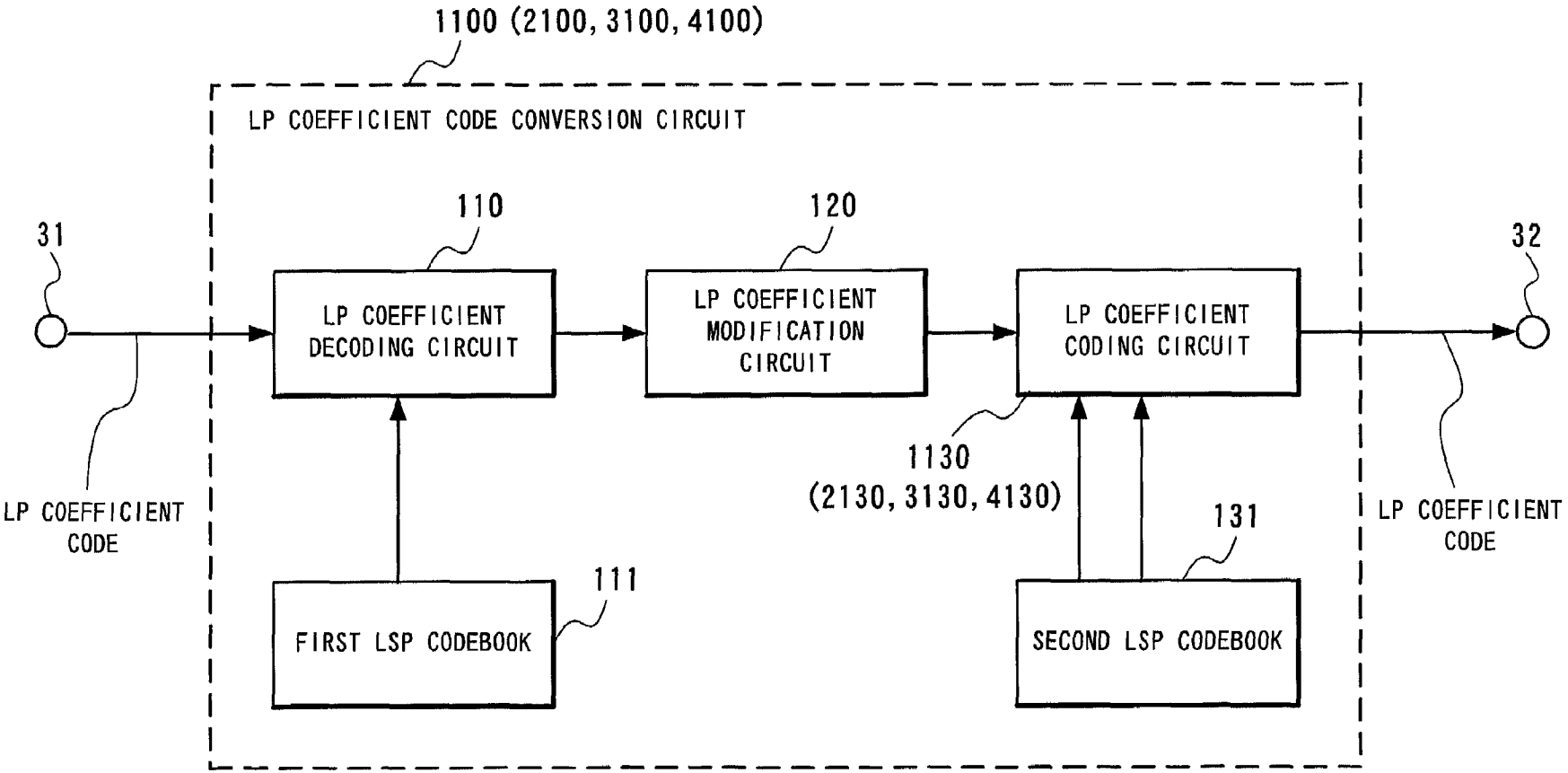
FIG. 2 is a diagram showing a structure of a linear prediction (LP) coefficient code conversion circuit in the code conversion device according to the first to fourth embodiments of the present invention.
Figure 14:
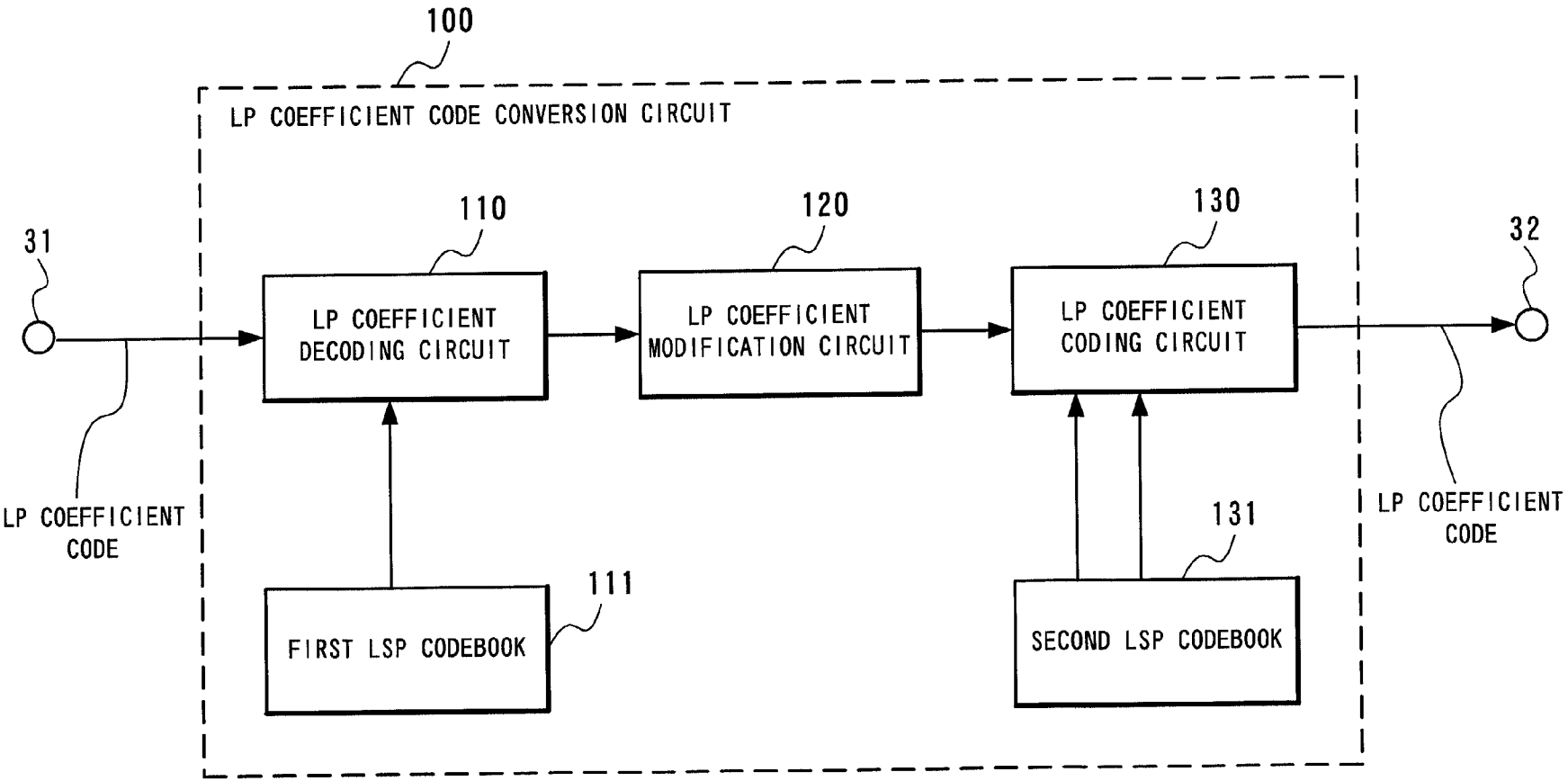
FIG. 14 (PRIOR ART)
FIG. 14 is a diagram showing a structure of an LP coefficient code conversion circuit in the conventional code conversion device.
Figure 15:
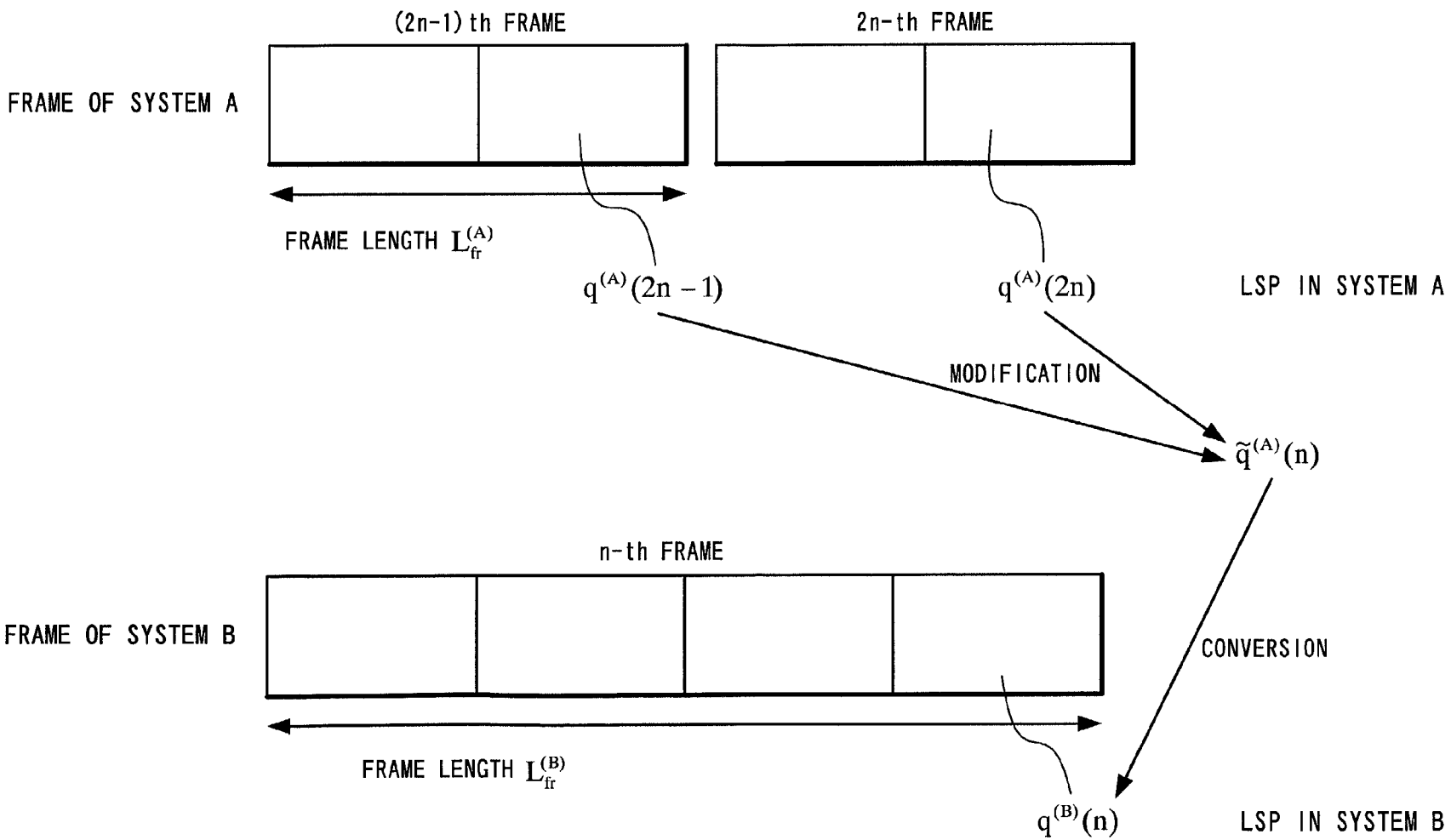
FIG. 15 (PRIOR ART)
FIG. 15 is a diagram for use in explaining a relationship between a frame in a first system (system A) and a frame in a second system (system B)

FIG. 2 is a diagram showing a structure of the LP coefficient code conversion circuit 1100. The difference between the structure of the LP coefficient code conversion circuit 1100 and that of the LP coefficient code conversion circuit 100 shown in FIG. 14 is that the LP coefficient coding circuit 130 is replaced by an LP coefficient coding circuit 1130 with reference to FIG. 2. Since also in the second, third and fourth embodiments which will be described later, the difference resides in that the LP coefficient coding circuit 130 is replaced by LP coefficient coding circuits 2130, 3130 and 4130, respectively, these reference numerals are indicated together to use FIG. 2 also for these embodiments similarly to the above-described case of FIG. 1.

Figure 3:
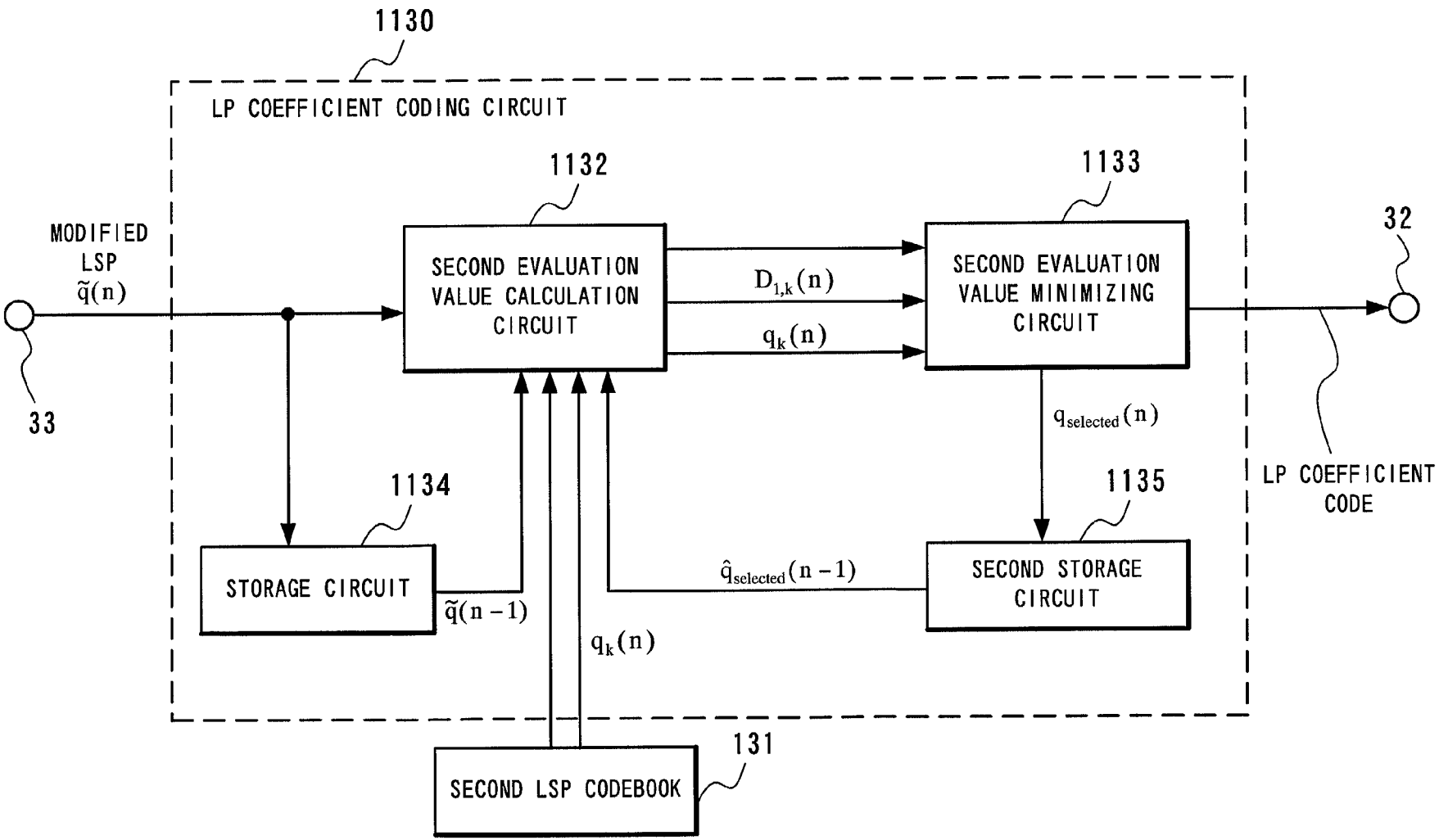
FIG. 3 is a diagram showing a structure of an LP coefficient coding circuit in the code conversion device according to the first embodiment of the present invention.
Figure 16:
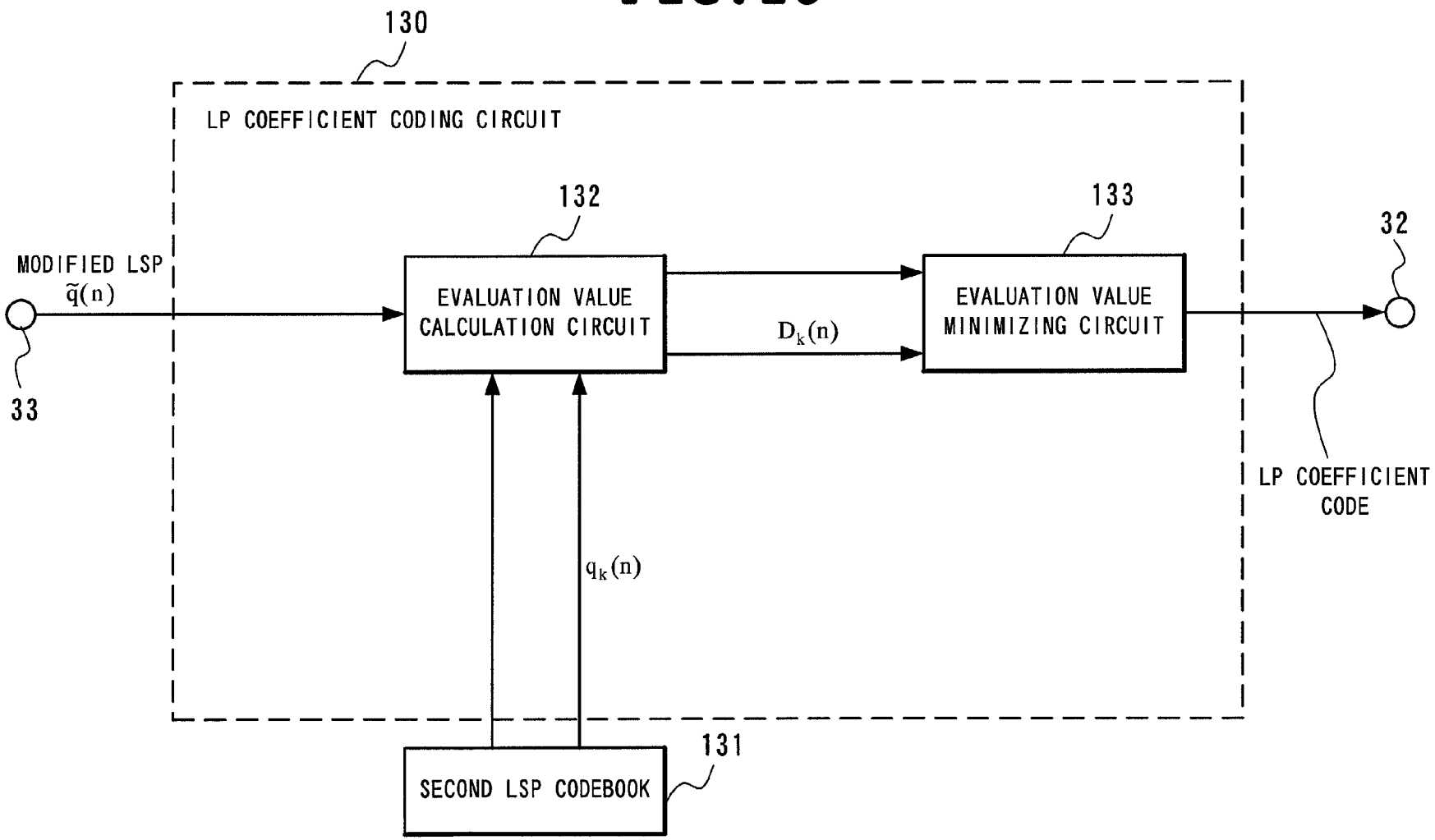
FIG. 16 (PRIOR ART)
FIG. 16 is a diagram showing a structure of an LP coefficient coding circuit in the conventional code conversion device.

FIG. 3 is a diagram showing a structure of the LP coefficient coding circuit 1130. In FIG. 3, the same or equivalent elements as/to those in FIG. 16 are given the same reference numerals. In FIG. 3, since the input terminal 33, the output terminal 32 and the second LSP codebook 131 are the same elements as those illustrated in FIG. 16, no description will be made thereof and in the following, description will be made mainly with respect to a difference from the structure shown in FIG. 16.

With reference to FIG. 3, in the LP coefficient coding circuit 1130, in addition to the components shown in FIG. 16, a storage circuit 1134 and a second storage circuit 1135 are provided and the evaluation value calculation circuit 132 and the evaluation value minimizing circuit 133 are replaced by a second evaluation value calculation circuit 1132 and a second evaluation value minimizing circuit 1133, respectively.

The storage circuit 1134 receives input of a modified LSP output from the LP coefficient modification circuit 120 through the input terminal 33 to hold the same. Then, the circuit 1134 outputs the held modified LSP which was input in the past to the second evaluation value calculation circuit 1132.

The second storage circuit 1135 receives input of an LSP selected (selected LSP) at the second evaluation value minimizing circuit 1133 to hold the same. Then, the circuit 1135 outputs the held selected LSP which was input in the past to the second evaluation value calculation circuit 1132.

The second evaluation value calculation circuit 1132 receives input of the modified LSP output from the LP coefficient modification circuit 120 through the input terminal 33, input of the past modified LSP output from the storage circuit 1134, and input of the past selected LSP output from the second storage circuit 1135, reads an LSP and its corresponding code from the second LSP codebook 131 in which a plurality of sets of LSP are stored and calculates an evaluation value from the read LSP and code to output the evaluation value and the LSP and the code read from the LSP codebook to the second evaluation value minimizing circuit 1133. Calculation of the evaluation value is made with respect to all the LSP stored in the LSP codebook. The evaluation value is defined as the amount obtained by adding, to a square error between a modified LSP as a target and an LSP stored in the LSP codebook, a square error between the following amount of change in time of the modified LSP as a target:

$$\Delta\tilde{q}_i(n)/\Delta n$$

and the following amount of change in time of a selected LSP:

$$\Delta\tilde{q}_{k,i}(n)/\Delta n$$

which obtained amount is expressed by the following equation:

$$D_{1,k}(n) = (1-\mu)\cdot\sum_{i=1}^{P}(\tilde{q}_i(n)-\hat{q}_{k,i}(n))^2 + \mu\cdot\sum_{i=1}^{P}\left(\frac{\Delta\tilde{q}_i(n)}{\Delta n}-\frac{\Delta\hat{q}_{k,i}(n)}{\Delta n}\right)^2 \text{ or}$$

$$D_{1,k}(n) = \sum_{i=1}^{P}(\tilde{q}_i(n)-\hat{q}_{k,i}(n))^2 + \mu\cdot\sum_{i=1}^{P}\left(\frac{\Delta\tilde{q}_i(n)}{\Delta n}-\frac{\Delta\hat{q}_{k,i}(n)}{\Delta n}\right)^2$$

wherein $D_{1,k}^{(n)}$ represents an evaluation value of the n-th frame, and the following expressions each represent the i-th element:

$$\Delta\tilde{q}_i(n)$$

and $$\Delta\tilde{q}_{k,i}(n)$$

of the following P-dimensional vectors (P: linear prediction degree):

$$\tilde{q}(n)=\tilde{q}^{(A)}(n)$$

and $$\hat{q}_k(n)$$

and the following expression represents a modified LSP in the n-th frame:

$$\tilde{q}(n)=\tilde{q}^{(A)}(n)$$

and the following expression represents an LSP read from the LSP codebook in the n-th frame:

$$\hat{q}_k(n)$$

wherein k=1, . . . , $N_{qcb}$, $N_{qcb}$ represents the size of the LSP codebook (the number of LSP sets stored). In addition, μ represents a coefficient which controls the degree of contribution of the second term in the evaluation value, which, for the purpose of simplification here, is assumed to be a certain constant (e.g. 0.4). The amount of change in time of a modified LSP and the amount of change in time of a selected LSP are represented by the following expressions, respectively:

$$\frac{\Delta\tilde{q}_k(n)}{\Delta n} = \tilde{q}_i(n) - \tilde{q}_i(n-1) \text{ and}$$

$$\frac{\Delta\tilde{q}_k(n)}{\Delta n} = \hat{q}_{k,i}(n) - \hat{q}_{selected,i}(n-1)$$

wherein $\hat{q}_{selected,i}(n)$ represents the i-th element of a P-dimensional vector represented by $\hat{q}_{selected}(n)$ and $\hat{q}_{selected}(n)$ represents a selected LSP in the n-th frame.

The second evaluation value minimizing circuit 1133 receives input of the evaluation value output from the second evaluation value calculation circuit 1132, input of the LSP used in the calculation of the evaluation value and input of the code corresponding thereto and selects an LSP with which the evaluation value is the minimum and a code corresponding to the same to output the selected LSP (selected LSP) to the second storage circuit 1135 and the selected code as an LP coefficient code to the code multiplexing circuit 1020 through the output terminal 32.

Next, a second embodiment of the present invention will be described. FIG. 1 is the diagram showing a structure of a code conversion device according to the second embodiment of the present invention. As described above, the present embodiment shares FIG. 1 with the first embodiment. Since the difference in the structure of FIG. 1 as a diagram showing the second embodiment from the structure illustrated in FIG. 12 resides in that the LP coefficient code conversion circuit 100 is replaced by the LP coefficient code conversion circuit 2100 and a difference between the LP coefficient code conversion circuit 2100 and the LP coefficient code conversion circuit 100 in the conventional device resides in that the LP coefficient coding circuit 130 is replaced by the LP coefficient coding circuit 2130, the following description will be made of the LP coefficient coding circuit 2130.

Figure 4:
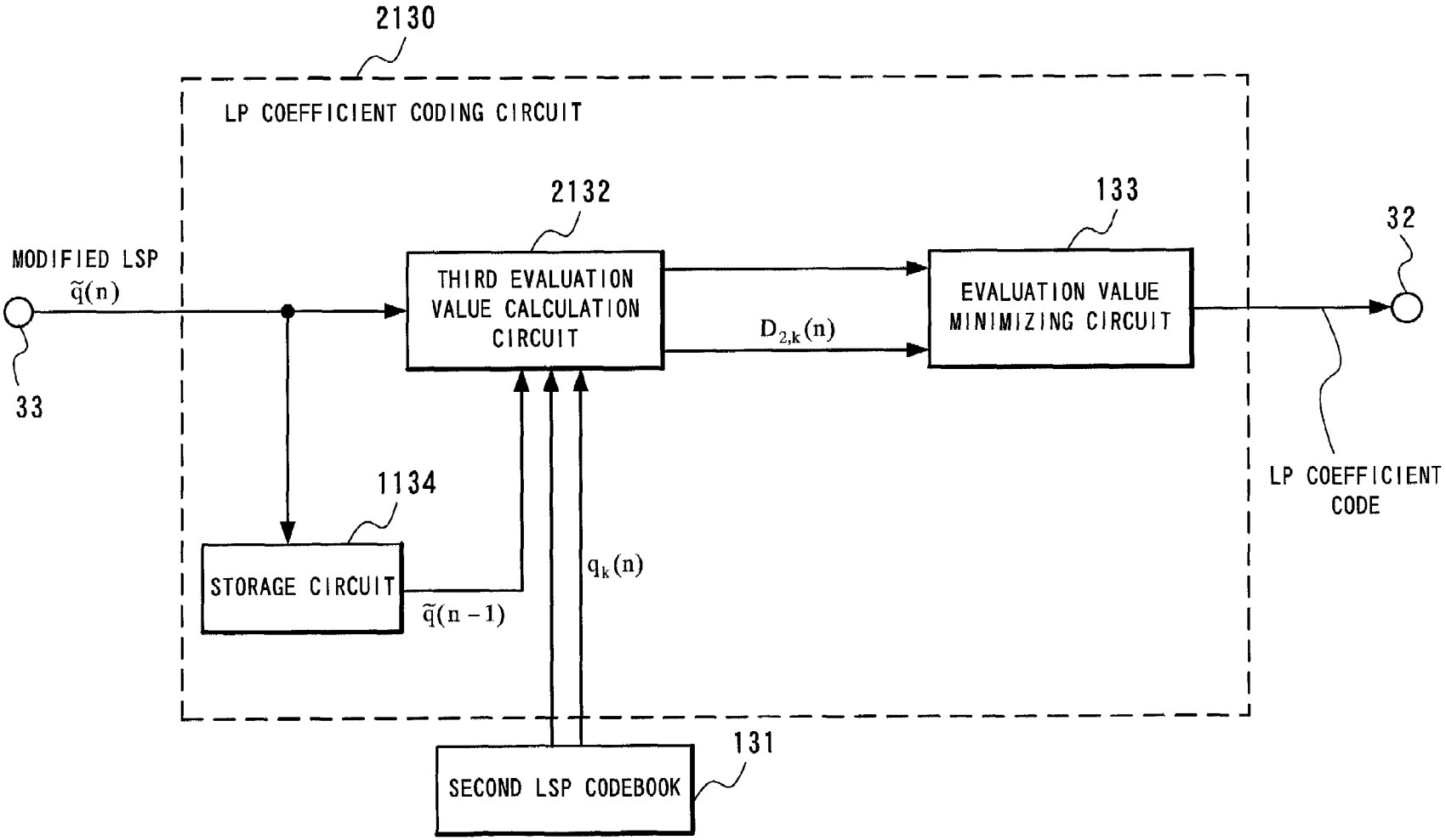
FIG. 4 is a diagram showing a structure of an LP coefficient coding circuit in the code conversion device according to the second embodiment of the present invention.

FIG. 4 is a diagram showing a structure of the LP coefficient coding circuit 2130 in the code conversion device according to the second embodiment of the present invention. In FIG. 4, the same or equivalent elements as/to those in FIGS. 3 and 16 are given the same reference numerals.

With reference to FIG. 4, in the LP coefficient coding circuit 2130, in addition to the components illustrated in FIG. 16, the storage circuit 1134 is further provided and the evaluation value calculation circuit 132 is replaced by a third evaluation value calculation circuit 2132. Since in FIG. 4, the input terminal 33, the output terminal 32, the second LSP codebook 131 and the evaluation value minimizing circuit 133 are the same elements as those shown in FIG. 16 and the storage circuit 1134 is the same element as that shown in FIG. 3, no description will be made thereof.

The third evaluation value calculation circuit 2132 receives input of the modified LSP output from the LP coefficient modification circuit 120 through the input terminal 33, receives input of the past modified LSP output from the storage circuit 1134, reads an LSP and a code corresponding to the same from the second LSP codebook 131 in which a plurality of sets of LSP are stored and calculates an evaluation value from the LSP and the code to output the evaluation value and the code to the evaluation value minimizing circuit 133. Calculation of the evaluation value is made with respect to all the LSP stored in the LSP codebook. The evaluation value is defined as the amount obtained by adding, to a square error between a modified LSP as a target and an LSP stored in the LSP codebook, a square error between a past modified LSP as a target and the LSP, which is expressed by the following equation:

$$D_{2,k}(n) = (1-\mu)\cdot\sum_{i=1}^{P}(\tilde{q}_i(n) - \hat{q}_{k,i}(n))^2 + \mu\cdot\sum_{i=1}^{P}(\tilde{q}_i(n-1) - \hat{q}_{k,i}(n))^2 \text{ or}$$

$$D_{2,k}(n) = \sum_{i=1}^{P}(\tilde{q}_i(n) - \hat{q}_{k,i}(n))^2 + \mu\cdot\sum_{i=1}^{P}(\tilde{q}_i(n-1) - \hat{q}_{k,i}(n))^2$$

wherein $D_{2,k}(n)$ represents an evaluation value of the n-th frame, and the following expressions each represent the i-th element:

$\Delta\tilde{q}_i(n)$ and $\Delta\tilde{q}_{k,i}(n)$ of the following P-dimensional vectors (P: linear prediction degree):

$\tilde{q}(n)=\tilde{q}^{(A)}(n)$ and $\hat{q}_k(n)$ the following expression represents a modified LSP in the n-th frame:

$\tilde{q}(n)=\tilde{q}^{(A)}(n)$ and the following expression represents an LSP read from the LSP codebook in the n-th frame:

$\hat{q}_k(n)$ wherein k=1, . . . , $N_{qcb}$, $N_{qcb}$ represents the size of the LSP codebook (the number of LSP sets stored). In addition, μ represents a coefficient which controls the degree of contribution of the second term in the evaluation value, which, for the purpose of simplification here, is assumed to be a certain constant (e.g. 0.4).

Next, a third embodiment of the present invention will be described. FIG. 1 is the diagram showing a structure of a code conversion device according to the third embodiment of the present invention. As described above, the present embodiment shares FIG. 1 with the first and second embodiments. Since the difference in structure of FIG. 1 as a diagram showing the third embodiment from the structure illustrated in FIG. 12 resides in that the LP coefficient code conversion circuit 100 is replaced by the LP coefficient code conversion circuit 3100 and a difference between the LP coefficient code conversion circuit 3100 and the LP coefficient code conversion circuit 100 in the conventional device resides in that the LP coefficient coding circuit 130 is replaced by the LP coefficient coding circuit 3130, the following description will be made of the LP coefficient coding circuit 3130.

Figure 5:
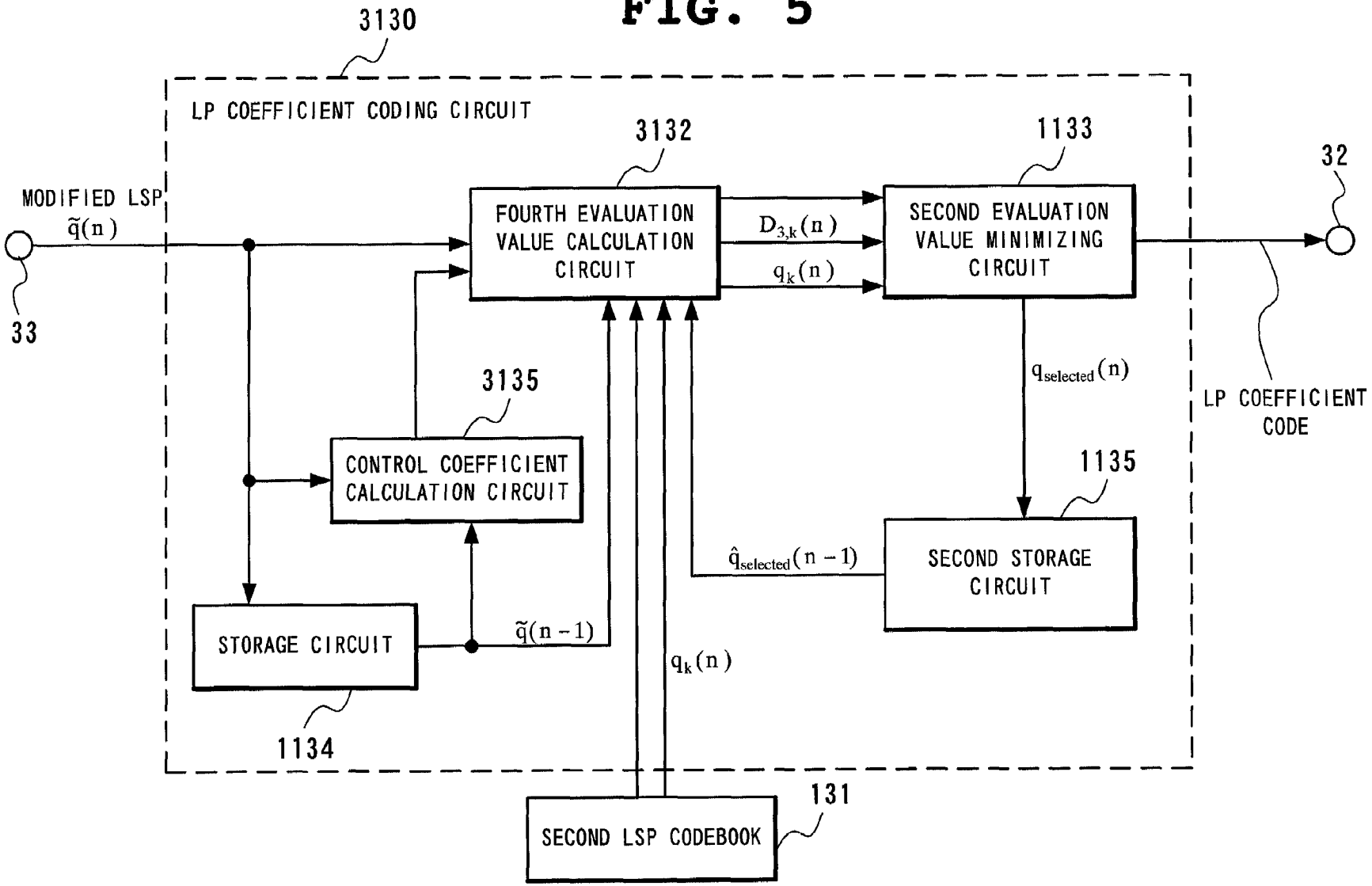
FIG. 5 is a diagram showing a structure of an LP coefficient coding circuit in the code conversion device according to the third embodiment of the present invention.

FIG. 5 is a diagram showing a structure of the LP coefficient coding circuit 3130 in the code conversion device according to the third embodiment of the present invention. In FIG. 5, the same or equivalent elements as/to those in FIGS. 3 and 16 are given the same reference numerals.

With reference to FIG. 5, in the LP coefficient coding circuit 3130, in addition to the components illustrated in FIG. 3, a control coefficient calculation circuit 3135 is further provided and the second evaluation value calculation circuit 132 is replaced by a fourth evaluation value calculation circuit 3132. Since in FIG. 5, the input terminal 33, the output terminal 32 and the second LSP codebook 131 are the same elements as those shown in FIG. 16 and the storage circuit 1134, the second storage circuit 1135 and the second evaluation value minimizing circuit 1133 are the same elements as those shown in FIG. 3, no description will be made thereof.

The fourth evaluation value calculation circuit 3132 receives input of the modified LSP output from the LP coefficient modification circuit 120 through the input terminal 33, input of a past modified LSP output from the storage circuit 1134 and input of a past selected LSP output from the second storage circuit 1135, reads an LSP and a code corresponding to the same from the second LSP codebook 131 in which a plurality of sets of LSP are stored, further receives input of a control coefficient output from the control coefficient calculation circuit 3135 and calculates an evaluation value from the LSP, the code and the coefficient to output the evaluation value and the LSP and the code read from the LSP codebook to the second evaluation value minimizing circuit 1133. Calculation of the evaluation value is conducted with respect to all the LSP stored in the LSP codebook. The evaluation value is defined as the amount obtained by adding, by a ratio determined by the control coefficient, to a square error between a modified LSP as a target and an LSP stored in the LSP codebook, a square error between the amount of change in time of the modified LSP as a target $\Delta\tilde{q}_{k,i}(n)/\Delta n$ and the amount of change in time of a selected LSP $\Delta\hat{q}_{k,i}(n)/\Delta n$ and is expressed as follows:

$$D_{3,k}(n) = (1-\mu(n))\cdot\sum_{i=1}^{P}(\tilde{q}_i(n)-\hat{q}_{k,i}(n))^2+\mu(n)\cdot\sum_{i=1}^{P}\left(\frac{\Delta\tilde{q}_i(n)}{\Delta n}-\frac{\Delta\hat{q}_{k,i}(n)}{\Delta n}\right)^2 \text{ or}$$

$$D_{3,k}(n) = \sum_{i=1}^{P}(\tilde{q}_i(n)-\hat{q}_{k,i}(n))^2+\mu(n)\cdot\sum_{i=1}^{P}\left(\frac{\Delta\tilde{q}_i(n)}{\Delta n}-\frac{\Delta\hat{q}_{k,i}(n)}{\Delta n}\right)^2$$

wherein $D_{3,k}(n)$ represents an evaluation value of the n-th frame, and the following expressions each represent the i-th element:

$\Delta\tilde{q}_i(n)$ and $\Delta\tilde{q}_{k,i}(n)$ of the following P-dimensional vectors (P: linear prediction degree):

$\tilde{q}(n)=\tilde{q}^{(A)}(n)$ and $\hat{q}_k(n)$ the following expression represents a modified LSP in the n-th frame:

$\tilde{q}(n)=\tilde{q}^{(A)}(n)$ and the following expression represents an LSP read from the LSP codebook in the n-th frame:

$\hat{q}_k(n)$ wherein k=1, . . . , $N_{qcb}$, $N_{qcb}$ represents the size of the LSP codebook (the number of LSP sets stored). In addition, μ(n) represents the control coefficient in the n-th frame which controls the degree of contribution of the second term in the evaluation value. The amount of change in time of the modified LSP and the amount of change in time of the selected LSP are expressed by the following expressions, respectively:

$$\frac{\Delta\tilde{q}_i(n)}{\Delta n} = \tilde{q}_i(n)-\tilde{q}_i(n-1) \text{ and}$$

$$\frac{\Delta\hat{q}_{k,i}(n)}{\Delta n} = \hat{q}_{k,i}(n)-\hat{q}_{selected,i}(n-1)$$

wherein the following expression represents the i-th element:

$\hat{q}_{selected,i}(n)$ of the following P-dimensional vector:

$\hat{q}_{selected}(n)$ while the following expression represents a selected LSP in the n-th frame:

$\hat{q}_{selected}(n)$

The control coefficient calculation circuit 3135 receives input of the modified LSP output from the LP coefficient modification circuit 120 through the input terminal 33 and input of the past modified LSP output from the storage circuit 1134. Then, from the modified LSP and the past modified LSP, the circuit 3135 calculates a control coefficient to output the coefficient to the fourth evaluation value calculation circuit 3132. The control coefficient μ(n) in the n-th frame is calculated by the following expression:

$\mu(n)=\mu_1$, if $d_q(n)<C_1$, $\mu(n)=a\cdot b_q(n)+b$, if $C_1\leqq d_q(n)<C_2$, $\mu(n)=\mu_2$, otherwise, wherein, for example, μ1 and μ2 are 0.6 and 0.1, respectively, a and b are −25 and 0.725, respectively, and C1 and C2 are 0.005 and 0.025, respectively. In addition, the following expressions each represent the i-th element:

$$d_q(n) = \sum_{i=1}^{P} \frac{\Delta\tilde{q}_i(n)}{\Delta n}$$

$$\frac{\Delta\tilde{q}_i(n)}{\Delta n} = \tilde{q}_i(n) - \tilde{q}_i(n-1)$$

and $\Delta\tilde{q}_i(n)$ of the following P-dimensional vector:

$\tilde{q}(n)=\tilde{q}^{(A)}(n)$ and the following expression represents a modified LSP in the n-th frame:

$\tilde{q}(n)=\tilde{q}^{(A)}(n)$

Next, a fourth embodiment of the present invention will be described. FIG. 1 is the diagram showing a structure of a code conversion device according to the fourth embodiment of the present invention. As described above, the present embodiment shares FIG. 1 with the first, second and third embodiments. Since the difference in structure of FIG. 1 as a diagram showing the fourth embodiment from the structure illustrated in FIG. 12 resides in that the LP coefficient code conversion circuit 100 is replaced by the LP coefficient code conversion circuit 4100 and a difference between the LP coefficient code conversion circuit 4100 and the LP coefficient code conversion circuit 100 in the conventional device resides in that the LP coefficient coding circuit 130 is replaced by the LP coefficient coding circuit 4130, the following description will be made of the LP coefficient coding circuit 4130.

Figure 6:
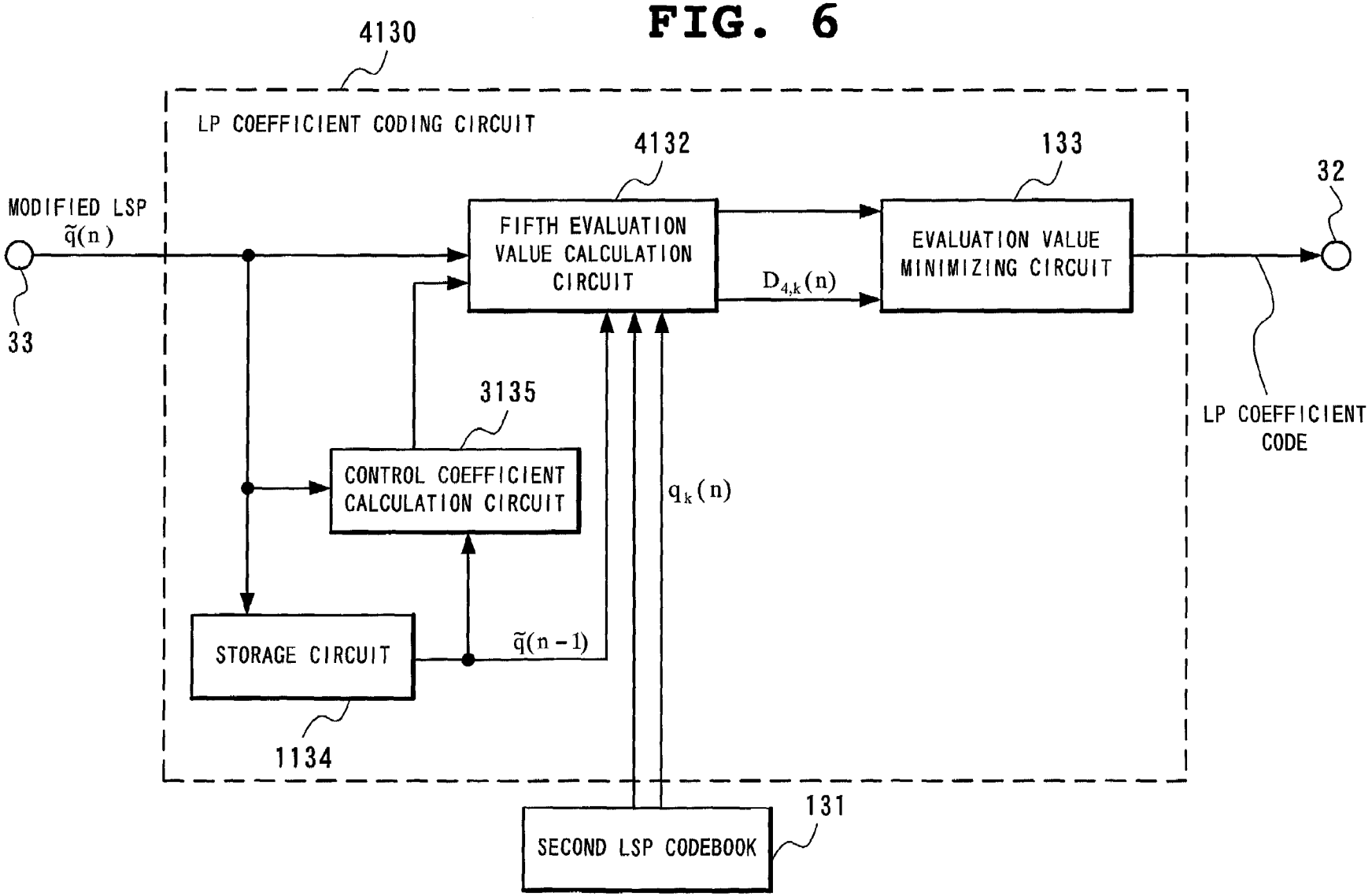
FIG. 6 is a diagram showing a structure of an LP coefficient coding circuit in the code conversion device according to the fourth embodiment of the present invention.

FIG. 6 is a diagram showing a structure of the LP coefficient coding circuit 4130 in the code conversion device according to the fourth embodiment of the present invention. In FIG. 6, the same or equivalent elements as/to those in FIGS. 3 and 16 are given the same reference numerals.

With reference to FIG. 6, in the LP coefficient coding circuit 4130, in addition to the components illustrated in FIG. 4, the control coefficient calculation circuit 3135 is further provided and the third evaluation value calculation circuit 2132 is replaced by a fifth evaluation value calculation circuit 4132. Since in FIG. 6, the input terminal 33, the output terminal 32, the second LSP codebook 131 and the evaluation value minimizing circuit 133 are the same elements as those shown in FIG. 16, the storage circuit 1134 is the same as the element shown in FIG. 3 and the control coefficient calculation circuit 3135 is the same as the element shown in FIG. 5, no description will be made thereof.

The fifth evaluation value calculation circuit 4132 receives input of the modified LSP output from the LP coefficient modification circuit 120 through the input terminal 33 and input of the past modified LSP output from the storage circuit 1134, reads an LSP and a code corresponding to the same from the second LSP codebook 131 in which a plurality of sets of LSP are stored, further receives input of a control coefficient output from the control coefficient calculation circuit 3135 and calculates an evaluation value from the LSP, the code and the coefficient to output the evaluation value and the code to the evaluation value minimizing circuit 133. Calculation of the evaluation value is made with respect to all the LSP stored in the LSP codebook. The evaluation value is defined as the amount obtained by adding, to a square error between a modified LSP as a target and an LSP stored in the LSP codebook, a square error between a past modified LSP as a target and the LSP, and is expressed as follows:

$$D_{4,k}(n) = (1-\mu(n)) \cdot \sum_{i=1}^{P} (\tilde{q}_i(n) - \hat{q}_{k,i}(n))^2 + \mu(n) \cdot \sum_{i=1}^{P} (\tilde{q}_i(n-1) - \hat{q}_{k,i}(n))^2 \text{ or}$$

$$D_{4,k}(n) = \sum_{i=1}^{P} (\tilde{q}_i(n) - \hat{q}_{k,i}(n))^2 + \mu(n) \cdot \sum_{i=1}^{P} (\tilde{q}_i(n-1) - \hat{q}_{k,i}(n))^2$$

wherein $D_{4,k}(n)$ represents an evaluation value of the n-th frame, and the following expressions:

$\Delta\tilde{q}_i(n)$ and $\Delta\tilde{q}_{k,i}(n)$ represent the i-th elements of the following respective P-dimensional vectors (P: linear prediction degree):

$\tilde{q}(n)=\tilde{q}^{(A)}(n)$ and $\Delta\tilde{q}_{k,i}(n)$ the following expression represents a modified LSP in the n-th frame:

$\tilde{q}(n)=\tilde{q}^{(A)}(n)$ and the following expression represents an LSP read from the LSP codebook in the n-th frame:

$\hat{q}_k(n)$ wherein k=1, . . . , $N_{qcb}$, $N_{qcb}$ represents the size of the LSP codebook (the number of LSP sets stored). In addition, $\mu(n)$ represents the control coefficient in the n-th frame, which controls the degree of contribution of the second term in the evaluation value.

Figure 7:
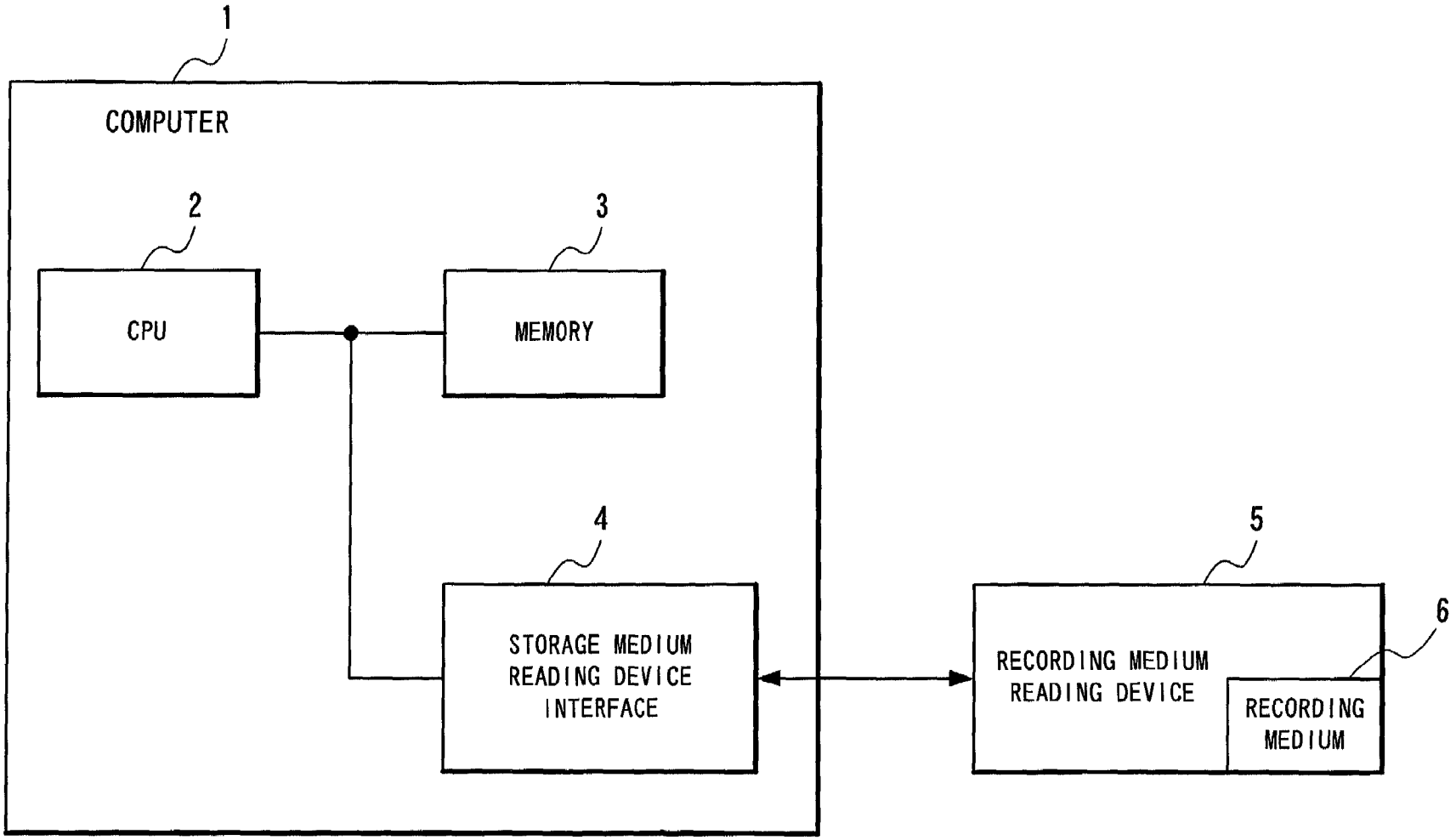
FIG. 7 is a diagram showing a structure of a code conversion device according to fifth to eighth embodiments of the present invention.

The above-described code conversion device according to each embodiment of the present invention may be realized by computer control of a digital signal processing processor or the like. FIG. 7 is a diagram schematically showing, as a fifth embodiment of the present invention, a structure of a device which realizes the above-described code conversion processing of each embodiment by a computer. At a computer 1 which executes a program read from a recording medium 6, in the execution of code conversion processing of converting a first code obtained by coding speech by a first coding and decoding device into a second code decodable by a second coding and decoding device, recorded in the recording medium 6 is a program for executing (a) processing of receiving input of a code corresponding to a linear prediction coefficient among the first codes and decoding the code by a linear prediction coefficient decoding method in the first coding and decoding device to obtain a first linear prediction coefficient, (b) processing of storing and holding the first linear prediction coefficient as a second linear prediction coefficient, (c) processing of calculating a first square error from a difference between the first linear prediction coefficient and a third linear prediction coefficient read from a table in which a plurality of linear prediction coefficients are stored in advance, calculating a first amount of change in time from a difference between the first linear prediction coefficient and the second linear prediction coefficient, calculating a second amount of change in time from a difference between the third linear prediction coefficient and a fourth linear prediction coefficient selected, and stored and held among the third linear prediction coefficients read in the past from the table, calculating a second square error from a difference between the first amount of change in time and the second amount of change in time, multiplying the second square error by a control coefficient and adding the obtained value to the first square error to calculate an evaluation value, (d) processing of selecting the third linear prediction coefficient with which the evaluation value is the minimum to output a code corresponding to the selected third linear prediction coefficient as a code decodable by a linear prediction coefficient decoding method in the second coding and decoding device, and (e) processing of storing and holding the selected third linear prediction coefficient as a fourth linear prediction coefficient. The program is read from the recording medium 6 into a memory 3 through a recording medium reading device 5 and an interface 4. The program may be stored in a non-volatile memory such as a mask ROM or a flash memory, and the recording medium includes, in addition to a non-volatile memory, such a medium as a CD-ROM, an FD, a digital versatile disk (DVD), a magnetic tape (MT) or a portable HDD, and in a case, for example, where the program is transmitted as a communication media by a computer from a server, it includes a wire or radio communication medium holding a program and the like.

Next, specific operation will be described with reference to a flow chart.

Figure 8:
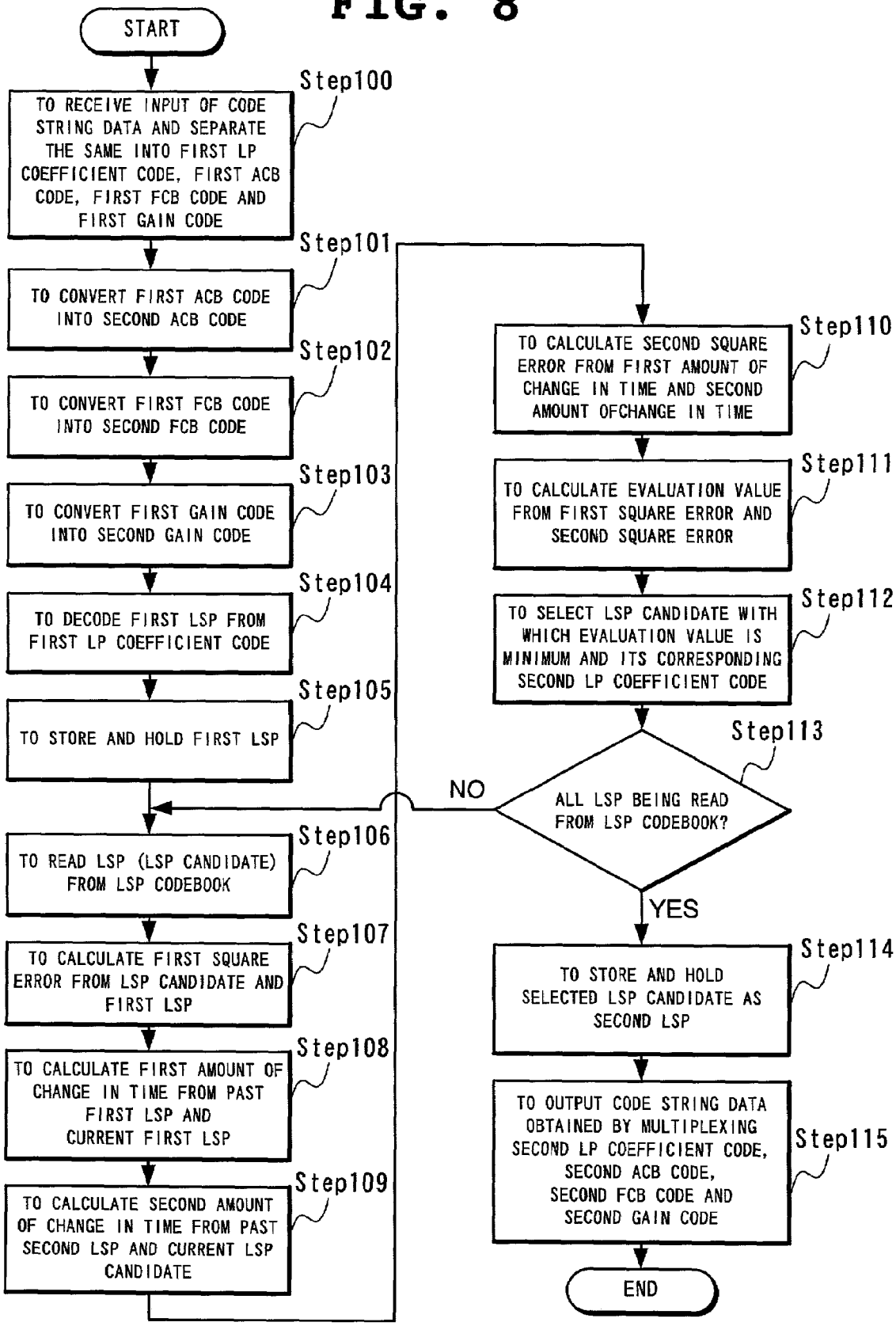
FIG. 8 is a flow chart showing operation of the fifth embodiment of the present invention.

FIG. 8 is a flow chart showing operation of the fifth embodiment.

First, receive input of a code string obtained by coding speech by the first system (system A) to separate, from the code string, codes corresponding to a linear prediction coefficient (LP coefficient), ACB, FCB, an ACB gain and an FCB gain, that is, a first LP coefficient code, a first ACB code, a first FCB code and a first gain code (Step 100). Here, assuming that the ACB gain and the FCB gain are coded and decoded in the lump and for the purpose of simplification, it will be referred to as a gain and its code as a gain code.

Convert the first ACB code into a second ACB code (Step 101). More specifically, re-read the first ACB code using a corresponding relationship between a code in the first system (system A) and a code in the second system (system B) to obtain the second ACB code.

Convert the first FCB code into a second FCB code (Step 102). More specifically, re-read the first FCB code using a corresponding relationship between a code in the system A and a code in the system B to obtain the second FCB code.

Convert the first gain code into a second gain code (Step 103). More specifically, decode the first gain code by a gain decoding method in the system A to obtain a first gain. Then, quantize and code the first gain by a gain quantizing and coding method in the system B to obtain the second gain code. Here, conversion of the gain code can be realized by the same method as that for the conversion of the LP coefficient code.

Subsequently, decode a first LSP from the first LP coefficient code (Step 104). More specifically, read an LSP corresponding to the first LP coefficient code from a first LSP codebook in which a plurality of sets of LSP are stored. Here, the decoding of the LSP from the LP coefficient code is conducted according to an LP coefficient (represented by LSP here) decoding method in the system A using an LSP codebook of the system A.

Store and hold the first LSP (Step 105). As described above, a modified LSP obtained by modifying the first LSP can be used in place of the first LSP. For the simplification, assuming that the first LSP is used here, no description will be made of modification of the LSP.

Sequentially read an LSP and its corresponding code from a second LSP codebook in which a plurality of sets of LSP are stored to regard the read LSP as an LSP candidate (Step 106). Here, as the second LSP codebook, an LSP codebook of the system B is used.

Calculate a first square error from the LSP candidate and the first LSP (Step 107). Here, the first square error is expressed by the following expression:

$$E_{1,k}(n) = \sum_{i=1}^{P} (\tilde{q}_i(n) - \hat{q}_{k,i}(n))^2$$

wherein $E_{1,k}(n)$ represents the first square error in the n-th frame, the following expressions each represent the i-th element:

$$\tilde{q}_i(n)$$

and $$\hat{q}_{k,i}(n)$$

of the following respective P-dimensional vectors (P: linear prediction degree):

$$\tilde{q}(n)=\tilde{q}^{(A)}(n)$$

and $$\hat{q}_k(n)$$

the following expression represents the first LSP in the n-th frame:

$$\tilde{q}(n)=\tilde{q}^{(A)}(n)$$

and the following expression represents the LSP candidate in the n-th frame:

$$\hat{q}_k(n)$$

wherein k=1, . . . , $N_{qcb}$, with $N_{qcb}$ representing the size of the LSP codebook (the number of LSP sets stored).

Calculate a first amount of change in time from the past first LSP stored and held and the current first LSP (Step 108). Here, the first amount of change in time is expressed by the following equation:

$$\frac{\Delta\tilde{q}_i(n)}{\Delta n} = \tilde{q}_i(n) - \tilde{q}_i(n-1)$$

Next, calculate a second amount of change in time from the past second LSP stored and held and the LSP candidate (Step 109). Here, the second amount of change in time is expressed by the following equation:

$$\frac{\Delta\hat{q}_{k,i}(n)}{\Delta n} = \hat{q}_{k,i}(n) - \hat{q}_{selected,i}(n-1)$$

wherein the following expression represents the i-th element:

$\hat{q}_{selected,i}(n)$ of the following P-dimensional vector:

$\hat{q}_{selected}(n)$ and the following expression represents the second LSP in the n-th frame:

$\hat{q}_{selected}(n)$

From the first amount of change in time and the second amount of change in time, calculate a second square error (Step 110). Here, the second square error is expressed as follows:

$$E_{2,k}(n) = \sum_{i=1}^{P}\left(\frac{\Delta\tilde{q}_i(n)}{\Delta n} - \frac{\Delta\hat{q}_{k,i}(n)}{\Delta n}\right)^2$$

From the first square error and the second square error, calculate an evaluation value (Step 111). Here, an evaluation value $D_{1,k}(n)$ in the n-th frame is expressed as follows:

$$D_{1,k}(n)=(1-\mu)\cdot E_{1,k}(n)+\mu\cdot E_{2,k}(n)$$

or $$D_{1,k}(n)=E_{1,k}(n)+\mu\cdot E_{2,k}(n)$$

wherein $E_{1,k}(n)$ represents the first square error in the n-th frame and $E_{2,k}(n)$ represents the second square error in the n-th frame. In addition, μ denotes a coefficient controlling the degree of contribution of the second term in the evaluation value, which for the purpose of simplification, is assumed to be a constant (e.g. 0.4).

Select an LSP candidate obtained when the second evaluation value has the minimum value and a code corresponding to the candidate and consider the selected LSP candidate as a second LSP and the selected code as a second LP coefficient code (Step 112).

When all the LSP stored in the second LSP codebook are read, proceed to Step 114 and otherwise return to Step 106 (Step 113).

Store and hold the second LSP selected at Step 112 (Step 114).

Lastly, output a code string obtained by multiplexing the second LP coefficient code, the second ACB code, the second FCB code and the second gain code (Step 115).

The foregoing is the description of the fifth embodiment.

Next, a sixth embodiment of the present invention will be described.

According to the sixth embodiment, at the computer 1 which executes a program read from the recording medium 6, in the execution of code conversion processing of converting a first code obtained by coding speech by a first coding and decoding device into a second code decodable by a second coding and decoding device, recorded in the recording medium 6 is a program for executing (a) processing of receiving input of a code corresponding to a linear prediction coefficient among the first codes and decoding the code by a linear prediction coefficient decoding method in the first coding and decoding device to obtain a first linear prediction coefficient, (b) processing of storing and holding the first linear prediction coefficient as a second linear prediction coefficient, (c) processing of calculating a first square error from a difference between the first linear prediction coefficient and a third linear prediction coefficient read from a table in which a plurality of linear prediction coefficients are stored in advance, calculating a third square error from a difference between the second linear prediction coefficient and the third linear prediction coefficient, multiplying the third square error by a control coefficient and adding the obtained value to the first square error to calculate an evaluation value, and (d) processing of selecting the third linear prediction coefficient with which the evaluation value is the minimum to output a code corresponding to the selected third linear prediction coefficient as a code decodable by a linear prediction coefficient decoding method in the second coding and decoding device.

In the following, specific operation will be described.

Figure 9:
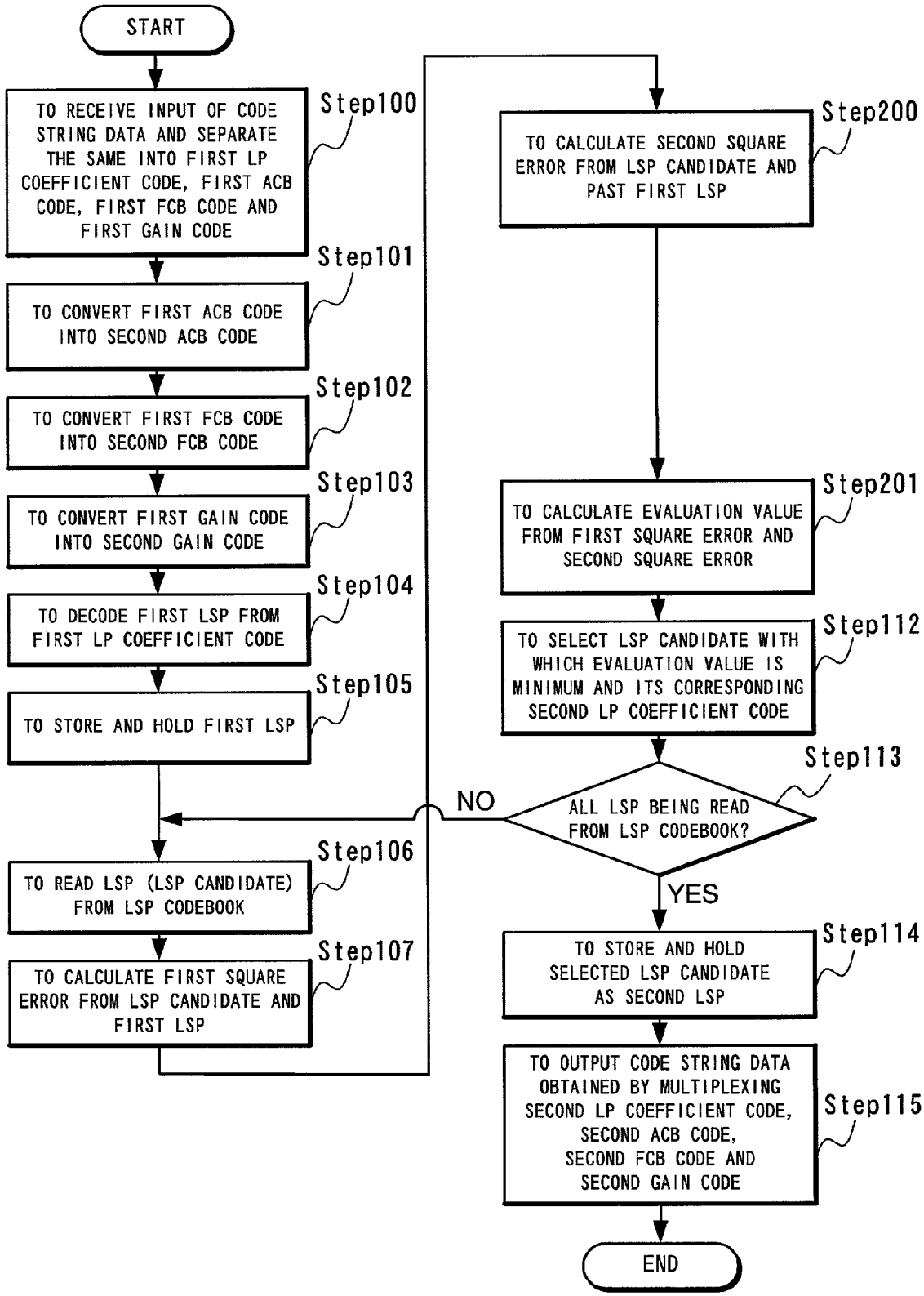
FIG. 9 is a flow chart showing operation of the sixth embodiment of the present invention.

FIG. 9 is a flow chart showing operation of the sixth embodiment. In the figure, the same steps as those in FIG. 8 are given the same step numbers to omit their description.

The sixth embodiment differs from the fifth embodiment in that Steps 108 to 110 in the fifth embodiment are replaced by Step 200. Description will be therefore made only of the different part.

More specifically, at Step 200, calculate a second square error from the past first LSP stored and held and the LSP candidate. Here, the second square error is expressed as follows:

$$E_{2a,k}(n) = \sum_{i=1}^{P}(\tilde{q}_i(n-1) - \hat{q}_{k,i}(n))^2$$

Then, at Step 111, calculate an evaluation value from the first square error and the second square error.

Here, the evaluation value $D_{2,k}(n)$ in the n-th frame is expressed as follows:

$$D_{2,k}(n)=(1-\mu)\cdot E_{1,k}(n)+\mu\cdot E_{2a,k}(n)$$

or $$D_{2,k}(n)=E_{1,k}(n)+\mu\cdot E_{2a,k}(n)$$

wherein $E_{1,k}(n)$ denotes a first square error in the n-th frame and $E_{2a,k}(n)$ denotes a second square error in the n-th frame. In addition, μ denotes a coefficient that controls the degree of contribution of the second term in the evaluation value, which for the purpose of simplification, is assumed to be a constant (e.g. 0.4).

The foregoing is the description of the sixth embodiment.

Next, a seventh embodiment of the present invention will be described.

According to the seventh embodiment, at the computer 1 which executes a program read from the recording medium 6, in the execution of code conversion processing of converting a first code obtained by coding speech by a first coding and decoding device into a second code decodable by a second coding and decoding device, recorded in the recording medium 6 is a program for executing (a) processing of receiving input of a code corresponding to a linear prediction coefficient among the first codes and decoding the code by a linear prediction coefficient decoding method in the first coding and decoding device to obtain a first linear prediction coefficient, (b) processing of storing and holding the first linear prediction coefficient as a second linear prediction coefficient, (c) processing of calculating an amount of change in time from a difference between the first linear prediction coefficient and the second linear prediction coefficient, and when the amount of change in time is less than a first threshold value, expressing a control coefficient by a first constant, when the amount of change in time is not less than the first threshold value and less than a second threshold value, expressing the control coefficient by a function of the amount of change in time and in the remaining cases, expressing the control coefficient by a second constant, (d) calculating a first square error from a difference between the first linear prediction coefficient and a third linear prediction coefficient read from a table in which a plurality of linear prediction coefficients are stored in advance, calculating a first amount of change in time from a difference between the first linear prediction coefficient and the second linear prediction coefficient, calculating a second amount of change in time from a difference between the third linear prediction coefficient and a fourth linear prediction coefficient selected, stored and held among the third linear prediction coefficients read in the past from the table, calculating a second square error from a difference between the first amount of change in time and the second amount of change in time, multiplying the second square error by the control coefficient and adding the obtained value to the first square error to calculate an evaluation value, (e) processing of selecting the third linear prediction coefficient with which the evaluation value is the minimum value to output a code corresponding to the selected third linear prediction coefficient as a code decodable by a linear prediction coefficient decoding method in the second coding and decoding device, and (f) processing of storing and holding the selected third linear prediction coefficient as a fourth linear prediction coefficient.

In the following, specific operation will be described.

Figure 10:
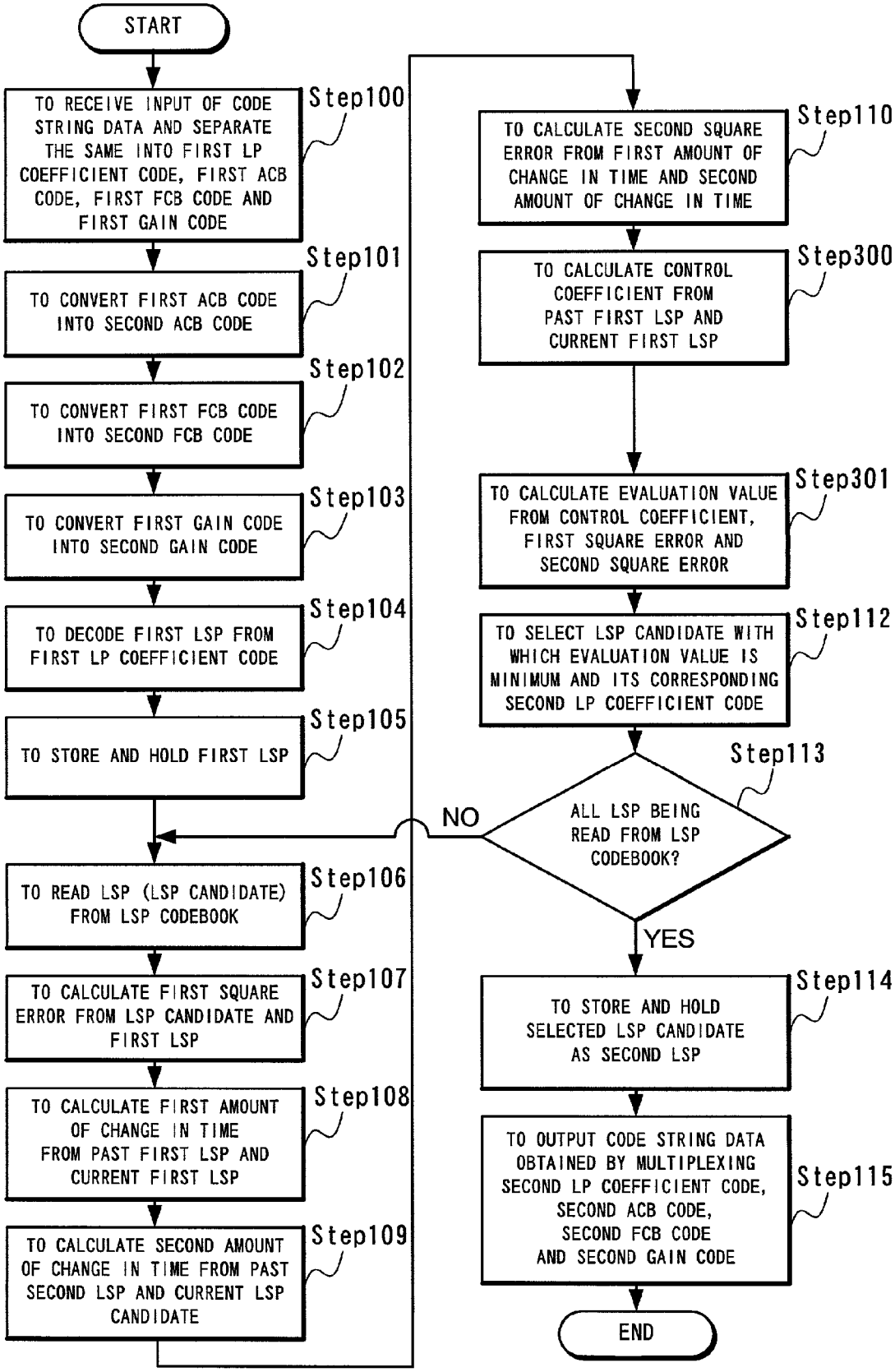
FIG. 10 is a flow chart showing operation of the seventh embodiment of the present invention.

FIG. 10 is a flow chart showing operation of the seventh embodiment. In the figure, the same steps as those in FIG. 8 are given the same step numbers to omit their description.

The seventh embodiment differs from the fifth embodiment in that Steps 111 and 112 in the fifth embodiment are replaced by Steps 300 and 301. Description will be therefore made only of the different part.

More specifically, at Step 300, calculate a control coefficient from the first LSP and the past first LSP stored and held. A control coefficient μ(n) in the n-th frame is calculated by following expression:

$$\mu(n)=\mu_1,\ \text{if } d_q(n)<C_1,$$

$$\mu(n)=a\cdot b_q(n)+b,\ \text{if } C_1\leqq d_q(n)<C_2,$$

$$\mu(n)=\mu_2,\ \text{otherwise},$$

wherein, for example, μ1 and μ2 are 0.6 and 0.1, respectively, a and b are −25 and 0.725, respectively, and C1 and C2 are 0.005 and 0.025, respectively. In addition, the following expressions hold:

$$d_q(n)=\sum_{i=1}^{P}\frac{\Delta\tilde{q}_i(n)}{\Delta n}\ \text{and}$$

-continued $$\frac{\Delta\tilde{q}_i(n)}{\Delta n}=\tilde{q}_i(n)-\tilde{q}_i(n-1)$$

with the following expression representing an i-th element:

$$\tilde{q}_i(n)$$

of a P-dimensional vector expressed as follows:

$$\tilde{q}(n)=\tilde{q}^{(A)}(n)$$

and the following expression representing a first LSP in the n-th frame:

$$\tilde{q}(n)=\tilde{q}^{(A)}(n)$$

Subsequently, from the control coefficient and the first and the second square errors, calculate an evaluation value (Step 301). Here, the evaluation value $D_{3,k}(n)$ in the n-th frame is expressed as follows:

$$D_{3,k}(n)=(1-\mu(n))\cdot E_{1,k}(n)+\mu(n)\cdot E_{2,k}(n)$$

or $$D_{3,k}(n)=E_{1,k}\mu(n)\cdot E_{2,k}(n)$$

wherein $E_{1,k}(n)$ denotes a first square error in the n-th frame and $E_{2,k}(n)$ denotes a second square error in the n-th frame. In addition, μ(n) denotes the control coefficient in the n-th frame, which controls the degree of contribution of the second term in the evaluation value.

The foregoing is the description of the seventh embodiment.

Lastly, an eighth embodiment will be described.

According to the eighth embodiment, at the computer 1 which executes a program read from the recording medium 6, in the execution of code conversion processing of converting a first code obtained by coding speech by a first coding and decoding device into a second code decodable by a second coding and decoding device, recorded in the recording medium 6 is a program for executing (a) processing of receiving input of a code corresponding to a linear prediction coefficient among the first codes and decoding the code by a linear prediction coefficient decoding method in the first coding and decoding device to obtain a first linear prediction coefficient, (b) processing of storing and holding the first linear prediction coefficient as a second linear prediction coefficient, (c) processing of calculating an amount of change in time from a difference between the first linear prediction coefficient and the second linear prediction coefficient, and when the amount of change in time is less than a first threshold value, expressing a control coefficient by a first constant, when the amount of change in time is not less than the first threshold value and less than a second threshold value, expressing the control coefficient by a function of the amount of change in time and in the remaining cases, expressing the control coefficient by a second constant, (d) calculating a first square error from a difference between the first linear prediction coefficient and a third linear prediction coefficient read from a table in which a plurality of linear prediction coefficients are stored in advance, calculating a third square error from a difference between the second linear prediction coefficient and the third linear prediction coefficient, multiplying the third square error by the control coefficient and adding the obtained value to the first square error to calculate an evaluation value, and (e) processing of selecting the third linear prediction coefficient with which the evaluation value is the minimum value to output a code corresponding to the selected third linear prediction coefficient as a code decodable by a linear prediction coefficient decoding method in the second coding and decoding device.

In the following, specific operation will be described.

Figure 11:
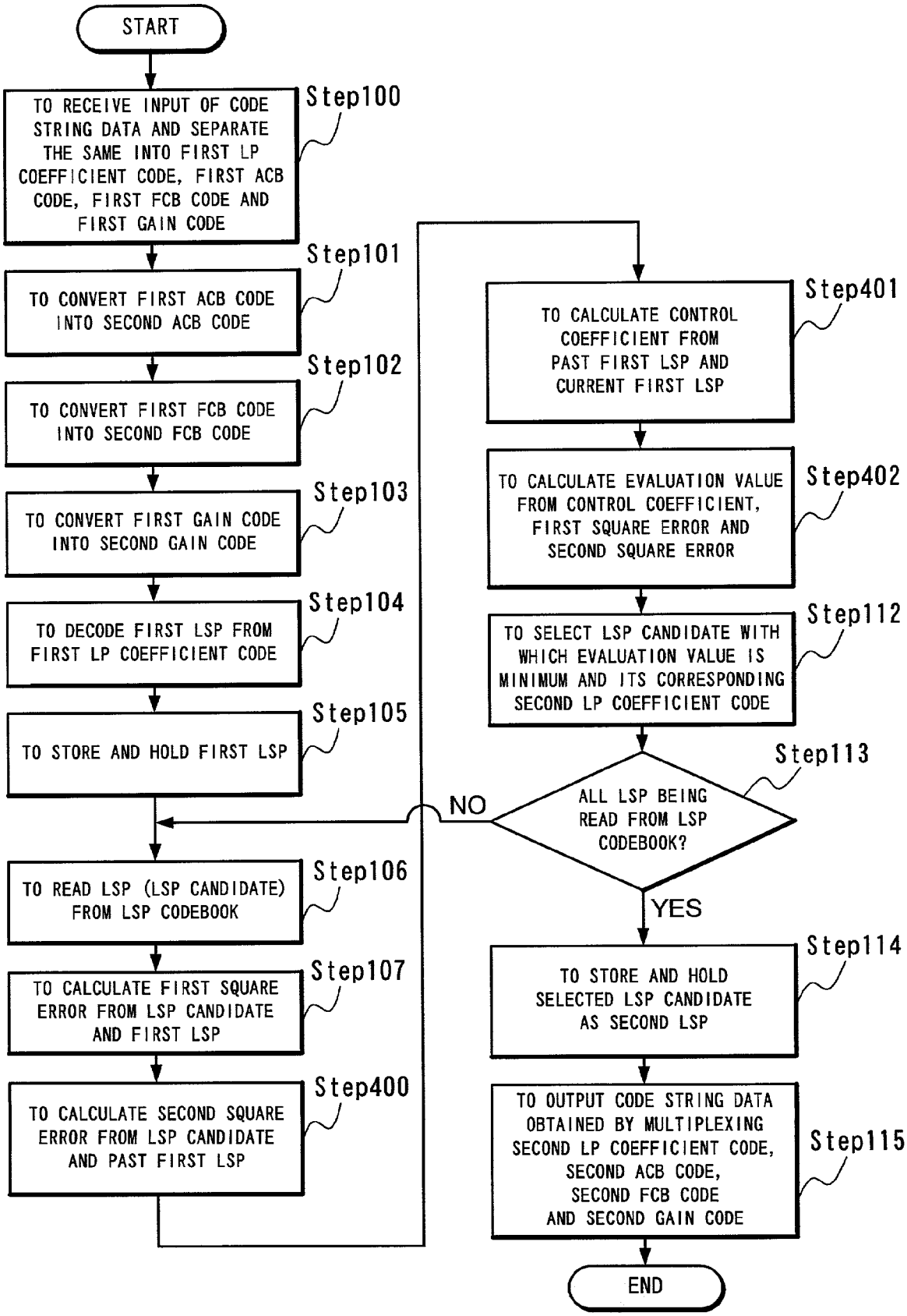
FIG. 11 is a flow chart showing operation of the eighth embodiment of the present invention.

FIG. 11 is a flow chart showing operation of the eighth embodiment. In the figure, the same steps as those in FIG. 8 are given the same step numbers to omit their description.

The eighth embodiment differs from the fifth embodiment in that Steps 108 to 111 in the fifth embodiment are replaced by Steps 400 to 402. Description will be therefore made only of the different part.

More specifically, at Step 400, calculate a second square error from the past first LSP stored and held and the LSP candidate. Here, the second square error is calculated by the following expression:

$$E_{2a,k}(n) = \sum_{i=1}^{P} (\tilde{q}_i(n-1) - \hat{q}_{k,i}(n))^2$$

Then, at Step 401, calculate a control coefficient from the first LSP and the past first LSP stored and held. A control coefficient μ(n) in the n-th frame is calculated by the following expression:

$$\mu(n)=\mu_1, \text{ if } d_q(n)<C_1,$$

$$\mu(n)=a\cdot b_q(n)+b, \text{ if } C_1 \leqq d_q(n)<C_2,$$

$$\mu(n)=\mu_2, \text{ otherwise},$$

wherein, for example, μ1 and μ2 are 0.6 and 0.1, respectively, a and b are −25 and 0.725, respectively, and C1 and C2 are 0.005 and 0.025, respectively. In addition, the following expressions hold:

$$d_q(n) = \sum_{i=1}^{P} \frac{\Delta\tilde{q}_i(n)}{\Delta n} \text{ and}$$

$$\frac{\Delta\tilde{q}_i(n)}{\Delta n} = \tilde{q}_i(n) - \tilde{q}_i(n-1)$$

with the following expression denoting an i-th element:

$$\tilde{q}_i(n)$$

of a P-dimensional vector expressed by the following expression:

$$\tilde{q}(n)=\tilde{q}^{(A)}(n)$$

and the following expression representing a first LSP in the n-th frame:

$$\tilde{q}(n)=\tilde{q}^{(A)}(n)$$

Subsequently, at Step 402, from the control coefficient and the first and the second square errors, calculate an evaluation value. Here, the evaluation value $D_{4,k}(n)$ in the n-th frame is expressed as follows:

$$D_{4,k}(n)=(1-\mu(n))\cdot E_{1,k}(n)+\mu(n)\cdot E_{2a,k}(n)$$

or $$D_{4,k}(n)=E_{1,k}(n)+\mu(n)\cdot E_{2a,k}(n)$$

wherein $E_{1,k}(n)$ denotes a first square error in the n-th frame and $E_{2a,k}(n)$ denotes a second square error in the n-th frame. In addition, μ(n) denotes the control coefficient in the n-th frame, which controls the degree of contribution of the second term in the evaluation value.

The foregoing is the description of the eighth embodiment.

In the above-described embodiment, the structure of the LP coefficient code conversion circuit is applicable also to the gain code conversion circuit and when applied, conversion of a gain code is possible by the same manner as that of conversion of an LP coefficient code. The reason is that it is only necessary to replace an LSP as a P-dimensional vector used in the foregoing description by a two-dimensional vector with the ACB gain and the FCB gain as its components.

Also in a case where the ACB gain and the FCB gain are not quantized and coded in the lump, that is, where each gain is scalar-quantized, in place of using the two-dimensional vector, by replacing the P-dimensional vector by each of one-dimensional vector (i.e. scalar) with the ACB gain as an element and one-dimensional vector with the FCB gain as an element, each of the ACB gain code and the FCB gain code can be converted in the same manner as that in the above-described LP coefficient code conversion.

As described above, the present invention produces the effect of suppressing generation of allophone in decoded speech which is generated from a code being converted and which derives from a striking difference between a mode of change in time of the parameter obtained from speech applied to a coder of the first system and a mode of change in time of the parameter obtained by decoding a converted code at a decoder in the second system.

The reason is that because the present invention is structured such that in code conversion between the first system and the second system, at the time of quantizing a parameter which is decoded from a code using a parameter decoding method in the first system by using a parameter quantization method in the second system, in order to make a mode of change in time of the quantized parameter approximate to that of the parameter yet to be quantized, an evaluation value is minimized which includes a difference between the amount of change in time of the parameter as of before quantization and that of after quantization, which difference is calculated, in the quantization, from the current and past parameters yet to be quantized and the current and past parameters being quantized, the difference in the amount of change in time of the parameters as of before and after quantization becomes small to result in reducing a difference between a mode of change in time of the parameter obtained from the input speech and a mode of change in time of the parameter obtained by decoding a converted code at the decoder in the second system.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A speech communication code conversion method of converting a first code string of a speech signal into a second code string of the speech signal, said method comprising the steps of:

a first step of obtaining a first line spectral pair from a code corresponding to a linear prediction coefficient out of said first code string, said first code string codable in a first coding and decoding system, a second step of storing and holding said first line spectral pair as a second line spectral pair, a third step of calculating, from said first line spectral pair, said second line spectral pair, a third line spectral pair sequentially read from a table in which a plurality of line spectral pairs are stored in advance, and a fourth line spectral pair selected, and stored and held among the third line spectral pairs read in the past from said table, an evaluation value for each said third line spectral pair, and a fourth step of selecting said third line spectral pair for which said evaluation value is the minimum from said table to output a code corresponding to said selected third line spectral pair as a converted code corresponding to a linear prediction coefficient in the second code string, and a fifth step of storing and holding said selected third line spectral pair as the fourth line spectral pair, wherein said converted code is decodable by a linear prediction coefficient decoding method in a second coding and decoding system such that the speech signal is interpretable by said first coding and decoding system and said second coding and decoding system.

2. The code conversion method as set forth in claim 1, wherein at said third step, a first square error is calculated from said first linear spectral pair and said third linear spectral pair and a second square error is calculated from said second linear spectral pair and said third linear spectral pair to calculate said evaluation value from said second square error and said first square error.

3. The code conversion method as set forth in claim 2, wherein said second square error is multiplied by a control coefficient and the multiplication result is added to said first square error to calculate said evaluation value.

4. The code conversion method as set forth in claim 3, wherein a third amount of change in time is calculated from said first linear spectral pair and said second linear spectral pair and said control-coefficient is calculated from said third amount of change in time.

5. The code conversion method as set forth in claim 4, wherein said third amount of change in time is calculated from a difference between said first linear spectral pair and said second linear spectral pair.

6. The code conversion method as set forth in claim 4, wherein when said third amount of change in time is less than a first threshold value, said control coefficient is expressed by a first constant, when said amount of change in time is not less than said first threshold value and less than a second threshold value, said control coefficient is expressed by a function of said third amount of change in time and in the remaining cases, said control coefficient is expressed by a second constant.

7. The code conversion method as et forth in claim 2, wherein a value obtained by internally dividing said first square error and said second square error by a ratio determined by a control coefficient is taken as said evaluation value.

8. The code conversion method as set forth in claim 1, wherein at said third step, a first square error is calculated from said first linear spectral pair and said third linear spectral pair, a first amount of change in time is calculated from said first linear spectral pair and said second linear spectral pair, a second amount of change in time is calculated from said third linear spectral pair and said fourth linear spectral pair, and a second square error is calculated from said first amount of change in time and said second amount of change in time to calculate said evaluation value from said second square error and said first square error.

9. The code conversion method as set forth in claim 8, wherein said first amount of change in time is calculated from a difference between said first linear spectral pair and said second linear spectral pair and said second amount of change in time is calculated from a difference between said third linear spectral pair and said fourth linear spectral pair.

10. The code conversion method as set forth in claim 1, wherein at said third step, a first difference between said first line spectral pair and said third line spectral pair is calculated and a second difference between said second line spectral pair and said third line spectral pair is calculated to calculate said evaluation value from said first difference and said second difference.

11. A code conversion device for converting a first code string of a speech signal into a second code string of the speech signal, said device comprising:

a linear prediction coefficient decoding circuit for obtaining a first line spectral pair from a code corresponding to a linear prediction coefficient out of said first code string codable in a first coding and decoding system, a storage circuit for storing and holding said first line spectral pair as a second line spectral pair, an evaluation value calculation circuit for calculating, from said first linear spectral pair, said second linear spectral pair, a third linear spectral pair sequentially read from a table in which a plurality of line spectral pairs are stored in advance, and a fourth linear spectral pair stored and held, an evaluation value for each said third line spectral pair, and an evaluation value minimizing circuit for selecting said third linear spectral pair for which said evaluation value is the minimum from said table to output a code corresponding to said selected third linear spectral pair as a converted code corresponding to a linear prediction coefficient in a second code string, and a second storage circuit for storing and holding said selected third linear spectral pair as the fourth linear spectral pair, wherein a linear prediction coefficient decoding method in a second coding and decoding system decodes said converted code such that the speech signal is interpretable by said first coding and decoding system and said second coding and decoding system.

12. The code conversion device as set forth in claim 11, wherein said evaluation value calculation circuit calculates a first square error from said first linear spectral pair and said third linear spectral pair and calculates a second square error from said second linear spectral pair and said third linear spectral pair to calculate said evaluation value from said second square error and said first square error.

13. The code conversion device as set forth in claim 12, wherein said evaluation value calculation circuit multiplies said second square error by a control coefficient and adds the multiplication result to said first square error to calculate said evaluation value.

14. The code conversion device as set forth in claim 13, wherein said evaluation value calculation circuit calculates a third amount of change in time from said first linear spectral pair and said second linear spectral pair to calculate said control coefficient from said third amount of change in time.

15. The code conversion device as set forth in claim 14, wherein said evaluation value calculation circuit calculates said third amount of change in time from a difference between said first linear spectral pair and said second linear spectral pair.

16. The code conversion device as set forth in claim 14, wherein when said third amount of change in time is less than a first threshold value, said evaluation value calculation circuit expresses said control coefficient by a first constant, when said amount of change in time is not less than said first threshold value and less than a second threshold value, expresses said control coefficient by a function of said third amount of change in time and in the remaining cases, expresses said control coefficient by a second constant.

17. The code conversion device as set forth in claim 12, wherein said evaluation value calculation circuit takes a value obtained by internally dividing said first square error and said second square error by a ratio determined by a control coefficient as said evaluation value.

18. The code conversion device as set forth in claim 11, wherein said evaluation value calculation circuit calculates a first square error from said first linear spectral pair and said third linear spectral pair, calculates a first amount of change in time from said first liner spectral pair and said second linear spectral pair, calculates a second amount of change in time from said third linear spectral pair and said fourth linear spectral pair, and calculates a second square error from said first amount of change in time and said second amount of change in time to calculate said evaluation value from said second square error and said first square error.

19. The code conversion device as set forth in claim 18, wherein said evaluation value calculation circuit calculates said first amount of change in time from a difference between said first linear spectral pair and said second linear spectral pair and calculates said second amount of change in time from a difference between said third linear spectral pair and said fourth linear spectral pair.

20. A code conversion program embedded and implemented in a computer readable medium for conducting code conversion by controlling a computer which forms a code conversion device for converting a first code string of a speech signal into a second code string of the speech signal, said program comprising the functions of:

a) obtaining a first line spectral pair from a code corresponding to a linear prediction coefficient out of said first code string codable in a first coding and decoding system, b) storing and holding said first line spectral pair as a second line spectral pair, c) calculating, from said first linear spectral pair, said second linear spectral pair, a third liner spectral pair sequentially read from a table in which a plurality of line spectral pairs are stored in advance, and a fourth linear spectral pair stored and held, an evaluation value for each said third line spectral pair, and d) selecting said third linear spectral pair with which said evaluation value is the minimum from said table to output the converted code corresponding to selected third linear spectral pair as a code corresponding to the linear prediction coefficient in the second code string, and e) storing and holding said selected third linear spectral pair as the fourth linear spectral pair, wherein said converted code being decodable by a linear prediction coefficient decoding method in a second coding and decoding system such that the speech signal is interpretable by said first coding and decoding system and said second coding and decoding system.

21. The code conversion program as set forth in claim 20, wherein said frmction (c) causes the computer to execute a function of calculating a first square error from said first linear spectral pair and said third linear spectral pair and calculating a second square error from said second linear spectral pair and said third linear spectral pair to calculate said evaluation value from said second square error and said first square error.

22. The code conversion program as set forth in claim 21, which causes the computer to execute a function of multiplying said second square error by a control coefficient and adding the multiplication result to said first square error to calculate said evaluation value.

23. The code conversion program as set forth in claim 22, which causes the computer to execute a function of calculating a third amount of change in time from said first linear spectral pair and said second linear spectral pair to calculate said control coefficient from said third amount of change in time.

24. The code conversion program as set forth in claim 23, which causes the computer to execute a function of calculating said third amount of change in time from a difference between said first linear spectral pair and said second linear spectral pair.

25. The code conversion program as set forth in claim 23, which causes the computer to execute a function of, when said third amount of change in time is less than a first threshold value, expressing said control coefficient by a first constant, when said amount of change in time is not less than said first threshold value and less than a second threshold value, expressing said control coefficient by a function of said third amount of change in time and in the remaining cases, expressing said control coefficient by a second constant.

26. The code conversion program as set forth in claim 21, which causes the computer to execute a function of taking a value obtained by internally dividing said first square error and said second square error by a ratio determined by a control coefficient as said evaluation value.

27. The code conversion program as set forth in claim 20, wherein said function (c) causes the computer to execute a function of calculating a first square error from said first linear spectral pair and said third linear spectral pair, calculating a first amount of change in time from said first linear spectral pair and said second linear spectral pair, calculating a second amount of change in time from said third linear spectral pair and said fourth linear spectral pair, and calculating a second square error from said first amount of change in time and said second amount of change in time to calculate said evaluation value from said second square error and said first square error.

28. The code conversion program as set forth in claim 27, which causes the computer to execute a function of calculating said first amount of change in time from a difference between said first linear spectral pair and said second linear spectral pair and calculating said second amount of change in time from a difference between said third linear spectral pair and said fourth linear spectral pair.

29. A code conversion method of converting a first code string of a speech signal into a second code sting of the speech signal, comprising the steps of:

a first step of obtaining a first gain from a code corresponding to a gain out of said first code string codable in a first coding and decoding system, a second step of storing and holding said first gain as a second gain, a third step of calculating, from said first gain, said second gain, a third gain sequentially read from a table in which a plurality of gains are stored in advance, and a fourth gain selected, stored and held among third gains read from said table in the past, an evaluation value for each said third gain, and a fourth step of selecting said third gain with which said evaluation value is the minimum from said table and the code corresponding to said selected third gain is output as a converted code corresponding to a gain in the second code string, and a fifth step of storing and holding said selected third gain as the fourth gain, wherein said converted code being decodable by a linear prediction coefficient decoding method in a second coding and decoding system such that the speech signal is interpretable by said first coding and decoding system and said second coding and decoding system.

30. The code conversion method as set forth in claim 29, wherein at said third step, a first square error is calculated from said first gain and said third gain and a second square error is calculated from said second gain and said third gain to calculate said evaluation value from said second square error and said first square error.

31. The code conversion method as set forth in claim 30, wherein said second square error is multiplied by a control coefficient and the multiplication result is added to said first square error to eafculate said evaluation value.

32. The code conversion method as set forth in claim 31, wherein a third amount of change in time is calculated from said first gain and said second gain to calculate said control coefficient from said third amount of change in time.

33. The code conversion method as set forth in claim 32, wherein said third amount of change in time is calculated from a difference between said first gain and said second gain.

34. The code conversion method as set forth in claim 32, wherein when said third amount of change in time is less than a first threshold value, said control coefficient is expressed by a first constant, when said amount of change in time is not less than said first threshold value and less than a second threshold value, said control coefficient is expressed by a function of said third amount of change in time and in the remaining cases, said control coefficient is expressed by a second constant.

35. The code conversion method as set forth in claim 30, wherein a value obtained by internally dividing said first square error and said second square error by a ratio determined by a control coefficient is taken as said evaluation value.

36. The code conversion method as set forth in claim 29, wherein at said third step, a first square error is calculated from said first gain and said third gain, a first amount of change in time is calculated from said first gain and said second gain, a second amount of change in time is calculated from said third gain and said fourth gain, and a second square error is calculated from said first amount of change in time and said second amount of change in time to calculate said evaluation value from said second square error and said first square error.

37. The code conversion method as set forth in claim 36, wherein said first amount of change in time is calculated from a difference between said first gain and said second gain and said second amount of change in time is calculated from a difference between said third gain and said fourth gain.

38. A code conversion device for converting a first code string of a speech signal into a second code string of the speech signal, said device comprising:

a gain decoding circuit for obtaining a first gain from a code corresponding to a gain out of said first code string codable in a first coding and decoding system, a storage circuit for storing and holding said first gain as a second gain, an evaluation value calculation circuit for calculating, from said first gain, said second gain, said third gain sequentially read from a table in which a plurality of gains are stored in advance, and a fourth gain stored and held, and an evaluation value minimizing circuit for selecting said third gain with which said evaluation value is the minimum from said table to output a code corresponding to said selected third gain as a converted code corresponding to a gain in the second code string, and a second storage circuit for storing and holding said selected third gain as the fourth gain, wherein said converted code being decodable by a linear prediction coefficient decoding method in a second coding and decoding system such that the speech signal is interpretable by said first coding and decoding system and said second coding and decoding system.

39. The code conversion device as set forth in claim 38, wherein said evaluation value calculation circuit calculates a first square error from said first gain and said third gain and a second square error from said second gain and said third gain to calculate said evaluation value from said second square error and said first square error.

40. The code conversion device as set forth in claim 39, wherein said second square error is multiplied by a control coefficient and the multiplication result is added to said first square error to calculate said evaluation value.

41. The code conversion device as set forth in claim 40, wherein a third amount of change in time is calculated from said first gain and said second gain to calculate said control coefficient from said third amount of change in time.

42. The code conversion device as set forth in claim 41, wherein said third amount of change in time is calculated from a difference between said first gain and said second gain.

43. The code conversion device as set forth in claim 41, wherein when said third amount of change in time is less than a first threshold value, said control coefficient is expressed by a first constant, when said amount of change in time is not less than said first threshold value and less than a second threshold value, said control coefficient is expressed by a function of said third amount of change in time and in the remaining cases, said control coefficient is expressed by a second constant.

44. The code conversion device as set forth in claim 39, wherein a value obtained by internally dividing said first square error and said second square error by a ratio determined by a control coefficient is taken as said evaluation value.

45. The code conversion device as set forth in claim 38, wherein said evaluation value calculation circuit calculates a first square error from said first gain and said third gain, a first amount of change in time from said first gain and said second gain, a second amount of change in time from said third gain and said fourth gain, and a second square error from said first amount of change in time and said second amount of change in time to calculate said evaluation value from said second square error and said first square error.

46. The code conversion device as set forth in claim 45, wherein said first amount of change in time is calculated from a difference between said first gain and said second gain and said second amount of change in time is calculated from a difference between said third gain and said fourth gain.

47. A code conversion program embedded and implemented in a computer readable medium for conducting code conversion by controlling a computer which forms a code conversion device for converting a first code string of a speech signal into a second code string of the speech signal, said program comprising the functions of:

(a) obtaining a first gain from a code corresponding to a gain out of said first code string codable in a first coding and decoding system, (b) storing and holding said first gain as a second gain, (c) calculating, from said first gain, said second gain, said third gain sequentially read from a table in which a plurality of gains are stored in advance, and a fourth gain stored and held, an evaluation value for each said third gain, and (d) selecting said third gain with which said evaluation value is the minimum from said table and outputting a code corresponding to said selected third gain as a converted code corresponding to a gain in the second code string, and (e) storing and holding said selected third gain as the fourth gain, wherein said converted code being decodable by a linear prediction coefficient decoding method in a second coding and decoding system such that the speech signal is interpretable by said first coding and decoding system and said second coding and decoding system.

48. The code conversion program as set forth in claim 47, wherein said function (c) causes the computer to execute a function of calculating a first square error from said first gain and said third gain and a second square error from said second gain and said third gain to calculate said evaluation value from said second square error and said first square error.

49. The code conversion program as set forth in claim 48, which causes the computer to execute a function of multiplying said second square error by a control coefficient and adding the multiplication result to said first square error to calculate said evaluation value.

50. The code conversion program as set forth in claim 49, which causes the computer to execute a function of calculating a third amount of change in time from said first gain and said second gain to calculate said control coefficient from said third amount of change in time.

51. The code conversion program as set forth in claim 50, which causes the computer to execute a function of calculating said third amount of change in time from a difference between said first gain and said second gain.

52. The code conversion program as set forth in claim 50, which causes the computer to execute a function of, when said third amount of change in time is less than a first threshold value, expressing said control coefficient by a first constant, when said amount of change in time is not less than said first threshold value and less than a second threshold value, expressing said control coefficient by a function of said third amount of change in time and in the remaining cases, expressing said control coefficient by a second constant.

53. The code conversion program as set forth in claim 48, which causes the computer to execute a function of taking a value obtained by internally dividing said first square error and said second square error by a ratio determined by a control coefficient as said evaluation value.

54. The code conversion program as set forth in claim 47, wherein said function (c) causes the computer to execute a function of calculating a first square error from said first gain and said third gain, a first amount of change in time from said first gain and said second gain, a second amount of change in time from said third gain and said fourth gain, and a second square error from said first amount of change in time and said second amount of change in time to calculate said evaluation value from said second square error and said first square error.

55. The code conversion program as set forth in claim 54, which causes the computer to execute a function of calculating said first amount of change in time from a difference between said first gain and said second gain and said second amount of change in time from a difference between said third gain and said fourth gain.

* * * * *